US010409189B2

(12) United States Patent
Ueda et al.

(10) Patent No.: US 10,409,189 B2
(45) Date of Patent: Sep. 10, 2019

(54) ELECTROSTATIC LATENT IMAGE DEVELOPER AND METHOD FOR PRODUCING ELECTROSTATIC LATENT IMAGE DEVELOPER

(71) Applicant: Konica Minolta, Inc., Tokyo (JP)

(72) Inventors: Junya Ueda, Hino (JP); Satoshi Uchino, Hino (JP); Shinya Obara, Fuchu (JP); Takuya Takahashi, Higashimurayama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/799,354

(22) Filed: Oct. 31, 2017

(65) Prior Publication Data

US 2018/0143557 A1 May 24, 2018

(30) Foreign Application Priority Data

Nov. 22, 2016 (JP) ..... 2016-226915

(51) Int. Cl.

| | |
|---|---|
| ***G03G 9/113*** | (2006.01) |
| ***G03G 9/097*** | (2006.01) |
| ***G03G 9/08*** | (2006.01) |
| ***G03G 9/087*** | (2006.01) |
| ***G03G 9/09*** | (2006.01) |
| ***G03G 9/093*** | (2006.01) |

(52) U.S. Cl.

CPC ..... *G03G 9/1133* (2013.01); *G03G 9/0808* (2013.01); *G03G 9/0819* (2013.01); *G03G 9/0827* (2013.01); *G03G 9/08711* (2013.01); *G03G 9/08755* (2013.01); *G03G 9/0902* (2013.01); *G03G 9/0904* (2013.01); *G03G 9/0926* (2013.01); *G03G 9/09392* (2013.01); *G03G 9/09708* (2013.01); *G03G 9/09716* (2013.01); *G03G 9/09725* (2013.01)

(58) Field of Classification Search

CPC .... G03G 9/08; G03G 9/09708; G03G 9/1133; G03G 9/0902; G03G 9/0926; G03G 9/0819; G03G 9/0815; G03G 9/0808

USPC ..... 430/108.6, 108.7

See application file for complete search history.

(56) References Cited

U.S. PATENT DOCUMENTS

| | | | | |
|---|---|---|---|---|
| 5,776,647 | A * | 7/1998 | Kido | G03G 9/0975 430/108.4 |
| 7,247,413 | B2 * | 7/2007 | Kido | G03G 9/093 430/109.4 |
| 7,547,499 | B2 * | 6/2009 | Veregin | G03G 9/0804 430/109.1 |
| 9,097,998 | B2 * | 8/2015 | Yamazaki | G03G 9/0821 |
| 2001/0051270 | A1 | 12/2001 | Yamashita et al. | |
| 2003/0224274 | A1 * | 12/2003 | Horikoshi | G03G 9/09708 430/108.6 |
| 2005/0026061 | A1 * | 2/2005 | Mikuriya | G03G 9/0804 430/108.1 |
| 2010/0330492 | A1 * | 12/2010 | Tsurumi | G03G 9/1075 430/111.1 |
| 2016/0246194 | A1 * | 8/2016 | Tsurumi | G03G 9/0823 |
| 2017/0277054 | A1 * | 9/2017 | Tanabe | G03G 9/1133 |

FOREIGN PATENT DOCUMENTS

| | | |
|---|---|---|
| JP | 2004126240 A | 4/2004 |
| JP | 2009098700 A | 5/2009 |

* cited by examiner

*Primary Examiner* — Janis L Dote

(74) *Attorney, Agent, or Firm* — Lucas & Mercanti, LLP

(57) ABSTRACT

The disclosure concerns an electrostatic latent image developer including: a toner having toner base particles and an external additive; and a carrier, wherein the external additive contains silicone oil-treated silica and titanium oxide, Net intensity of titanium (Ti) in the toner to be measured by X-ray fluorescence analysis is 0.5 to 5 kcps, the carrier has a resin coating layer coating core material particles, and the resin coating layer has a constituent unit formed from an alicyclic (meth)acrylic acid ester.

9 Claims, No Drawings

ELECTROSTATIC LATENT IMAGE DEVELOPER AND METHOD FOR PRODUCING ELECTROSTATIC LATENT IMAGE DEVELOPER

CROSS-REFERENCE TO RELATED APPLICATION

Japanese Patent Application No. 2016-226915 filed on Nov. 22, 2016, including description, claims, drawings, and abstract the entire disclosure is incorporated herein by reference in its entirety.

BACKGROUND

1. Technological Field

The present invention relates to an electrostatic latent image developer and a method for producing an electrostatic latent image developer.

2. Description of the Related Art

Hitherto, various compounds called external additives for providing and improving flowability or charging performance are added to an electrostatic latent image developing toner used to form an image by electrophotography. As representative external additives, inorganic particles of silica, titanium oxide, aluminum oxide, zinc oxide, magnesium oxide, cerium oxide, iron oxide, copper oxide, and the like are known.

Further, for printers or complex machines employing electrophotography, a technique has been required by which small-lot printed matters and a wide variety of printed matters including images having a low coverage rate as well as images having a high coverage rate such as entire surface solid images can be stably output over a long period of time. In particular, when images having a high coverage rate are continuously output, it is necessary not only to stable a toner charge amount but also to reliably clean a toner remaining on a photoreceptor after transferring.

In order to ensure such cleaning property, a technique of treating surfaces of inorganic particles that are external additives with an organic silicon compound such as dimethyldichlorosilane, hexamethyldisilazane, or silicone oil has been used. Among them, silicone oil exhibits sufficient hydrophobicity and has low surface energy. Thus, when silicone oil is contained in a toner, excellent transferability can be imparted to the toner. Accordingly, silicone oil is known as a preferred hydrophobizing treatment agent and various suggestions on silicone oil have been made.

For example, JP 2009-98700 A (US 2001/051270 A) discloses that when a free silicone degree of silicone oil in inorganic fine particles subjected to a silicone oil treatment is adjusted to a specific range, a stable image can be formed without defects in transfer. JP 2004-126240 A discloses a toner containing two kinds of silica fine particles subjected to a silane coupling agent treatment and a silicone oil treatment and titanium oxide fine particles as external additives. With such a configuration, lifetime of various members such as a drum photosensitive member and an intermediate transfer belt that are electrostatic image bearing members is intended to be lengthened.

SUMMARY

When inorganic particles subjected to a silicone oil treatment are used in a toner, transferability to a transfer member having concavities and convexities may be decreased in some cases.

An object of the present invention is to provide an electrostatic latent image developer having improved transferability to a transfer member having concavities and convexities while maintaining cleaning property. Another object of the present invention is to provide an electrostatic latent image developer having improved charge stability.

To achieve at least one of the abovementioned objects, an electrostatic latent image developer reflecting one aspect of the present invention includes the following. An electrostatic latent image developer including: a toner having toner base particles and an external additive; and a carrier, wherein the external additive contains silicone oil-treated silica and titanium oxide, Net intensity of titanium (Ti) in the toner to be measured by X-ray fluorescence analysis is 0.5 to 5 kcps, the carrier has a resin coating layer coating core material particles, and the resin coating layer has a constituent unit formed from an alicyclic (meth)acrylic acid ester.

DETAILED DESCRIPTION OF EMBODIMENTS

Hereinafter, one or more embodiments of the present invention will be described. However, the scope of the invention is not limited to the disclosed embodiments.

Incidentally, in the present specification, "X to Y" indicating the range means "X or more and Y or less". In addition, unless otherwise noted, operations and measurement of physical properties are performed under the conditions of room temperature (20 to 25° C.)/relative humidity 40 to 50% RH. Further, in the present specification, "(meth) acryl" means methacryl and/or acryl.

A first embodiment of the present invention is an electrostatic latent image developer containing: a toner having toner base particles and an external additive; and a carrier, in which the external additive contains silicone oil-treated silica and titanium oxide, Net intensity of titanium (Ti) in the toner to be measured by X-ray fluorescence analysis is 0.5 to 5 kcps, the carrier has a resin coating layer coating core material particles, and the resin coating layer has a constituent unit formed from an alicyclic (meth)acrylic acid ester. In the first embodiment, it is characterized in that a trace amount of titanium oxide is added in the external additive containing silicone oil-treated silica and titanium oxide and the resin of the resin coating layer constituting the carrier has a constituent unit formed from an alicyclic (meth)acrylic acid ester.

By using of the electrostatic latent image developer of the first embodiment of the present invention, an increase in the amount of the toner remaining on a photoreceptor is suppressed. That is, cleaning property is maintained and transferability to a transfer member having concavities and convexities is improved. Further, in addition to the description presented above, charge stability is improved.

The mechanism that the developer of the first embodiment exhibits such effects is estimated as follows. However, the technical scope of the present invention is not limited to the following mechanism.

As described above, the silicone oil treatment of silica is a very excellent treatment method as a technique of improving cleaning property among hydrophobizing treatment techniques (for example, comparison of Example 1 with Comparative Example 4 to be described later). However, although the cleaning property is improved by the silicone oil treatment, in some cases, transferability to a transfer member having concavities and convexities (hereinafter, transferability to a transfer member having concavities and convexities is simply referred to as concavity and convexity transferability) may be decreased or the charging ability of the developer may deteriorate after a long-term use as compared to the initial charging ability. Through the silicone oil treatment, silica present on surfaces of the toner base particles is easy to move on the surfaces of the toner base particles or silica is easy to aggregate or unevenly distribute. Thus, it is considered that the toner is not efficiently transferred to concave portions of the concavity and convexity transfer member and defects in transfer occurs. Further, through the silicone oil treatment, adhesiveness of silica to the toner base particles tends to decrease, but in the case of a long-term use of the toner, it is considered that desorption of silica from the surfaces of the toner base particles is significantly increased and the desorbed silica adheres to the carrier so that collision frequency between the toner and the carrier is reduced to decrease the charge amount.

On the other hand, when titanium oxide that has a larger specific gravity than silica exists in a trace amount, the silicone oil-treated silica is less likely to move on the surfaces of the toner base particles so that silica is less likely to be unevenly distributed on the surfaces of the toner base particles. It is considered that when silica is present evenly on the surface of the toner in this way, concavity and convexity transferability is improved. Furthermore, in general, the external additive is mixed with the toner base particles to constitute toner particles. Silica is easy to aggregate at the time of this mixing due to the silicone oil treatment, but when titanium oxide exists in a trace amount at the time of mixing, the aggregated silica is easily cracked so that silica is less likely to be unevenly distributed. Therefore, it is considered that even when titanium oxide exists in a trace amount at the time of producing the toner, concavity and convexity transferability is improved.

However, if the amount of titanium oxide is increased, the effect of improving cleaning property obtained by the silicone oil treatment is not obtainable (see Comparative Example 3 to be described later). The reason for this is considered that collision between titanium oxide and silica causes peeling-off of silicone oil so that the effect of the silicone oil treatment is not obtainable. Therefore, in the present invention, it is considered that the effect of the present invention is exerted when the amount of titanium oxide is small, preferably, when the amount of titanium oxide with respect to silica is also small.

However, the present inventors have found that the cleaning property is not maintained only by controlling the amount of titanium oxide with respect to silica as described above (for example, see Comparative Example 5 to be described later). As a result of studies based on various viewpoints, they have found that the cleaning property is maintained by using an alicyclic (meth)acrylic acid ester as a monomer that constitutes a resin constituting a resin coating layer. The mechanism that the above-described effects are exerted with the configuration of the present invention is considered as follows.

As described above, when a trace amount of titanium oxide is contained in the external additive, silica subjected to the silicone oil treatment is evenly present on the surface of the toner. However, since the average particle size of the silica present on the surface of the toner is decreased as compared to silica aggregates, it is considered that silica is easy to bury against collision with the carrier so that the effect thereof as the external additive is decreased to deteriorate the cleaning property. On the other hand, use of the alicyclic (meth)acrylic acid ester as a monomer for a resin constituting the resin coating layer causes a cyclic alkyl group unit to exist (=a bulk portion exists in a part of the molecule) so that impact caused when the toner and the carrier are collided with each other is moderated. Thus, burying of silica in the toner is suppressed, and even in the case of mixing silica with the toner, the silica subjected to the silicone oil treatment can be evenly present on the surface of the toner. Therefore, it is considered that the concavity and convexity transferability can be improved while the cleaning property is maintained.

Hereinafter, each component constituting the electrostatic latent image developer will be described.

[External Additive]

The external additive contains silicone oil-treated silica and titanium oxide.

<Silicone Oil-Treated Silica>

As silica, from the viewpoint of the effect of silica as an external additive, amorphous silica is preferable, and synthetic amorphous silica is more preferable.

As the method for producing silica which has yet to be subjected to the silicone oil treatment, any of a dry method (for example, a method of burning silicon tetrachloride in an oxygen or hydrogen flame, fumed silica that is a by-product at the time of metallic silicon production, or the like) and a wet method (a method of neutralizing sodium silicate with a mineral acid, hydrolysis (sol-gel method) of alkoxysilane) may be employed.

The silica which has yet to be subjected to the silicone oil treatment can be produced by a known method. Examples of the method for producing silica include a method of hydrolyzing alkoxysilane (a sol-gel method), a method of evaporating silicon chloride and performing a gas phase reaction in a hydrogen flame at a high temperature to synthesize silica particles (a gas phase method, a gas combustion method), and a method of heat-treating a mixed raw material, which is composed of finely pulverized silica, a reducing agent such as metallic silicon powder or carbon powder, and water used for forming a slurry, under a reducing atmosphere at a high temperature to generate SiO gas and cooling the SiO gas under an atmosphere containing oxygen (a melting method). From the viewpoint that silica having a narrow particle size distribution is easily obtained and a variation in adherence strength of the external additive to the toner base particles can be suppressed, the method for producing silica is preferably a sol-gel method.

Thus, hereinafter, a method for producing silica particles by a sol-gel method will be described.

Specifically, first, a TMOS hydrolysis liquid in which tetramethoxysilane (TMOS) is added to pure water is prepared. Then, this TMOS hydrolysis liquid is added to a liquid mixture with an alkali catalyst at a predetermined speed. Thereafter, the alkali catalyst is appropriately added while pH is adjusted, the TMOS hydrolysis liquid is added at the predetermined speed with a constant interval, and this operation is continuously performed. Thereafter, by performing hydrolysis and condensation, a mixed medium dispersion liquid of hydrophilic spherical silica particles can be obtained. Herein, the particle size (number average primary particle size) and the average circularity of the obtained silica particles can be controlled by changing the added amount of the alkali catalyst (the added amount with respect to TMOS) and/or the addition speed of the TMOS hydrolysis liquid. As the addition speed of the TMOS hydrolysis liquid is increased, the particle size of the silica particles tends to increase.

The alkali catalyst used in the sol-gel method is not particularly limited, but examples thereof include ammonia; urea; a monoamine compound such as trimethylamine, triethylamine, or dimethylethylamine; a diamine compound such as ethylenediamine, tetramethylethylene diamine, tetramethylpropylene diamine, or tetramethylbutylene diamine; a quaternary ammonium salt.

The number average primary particle size of the silica (particles) which has yet to be subjected to the silicone oil treatment is preferably 5 to 300 nm, more preferably 20 to 200 nm, further preferably 30 to 200 nm, further more preferably 30 to 150 nm, and particularly preferably 30 to 90 nm. Incidentally, a value to be measured by a method described in Examples is employed as the number average primary particle size. Incidentally, since the coating thickness of the silicone oil in the silicone oil treatment described below is small enough to be neglected with respect to the particle size of silica, the number average primary particle size of the silica which has yet to be subjected to the silicone oil treatment and the number average primary particle size of the silicone oil-treated silica are almost equal to each other.

The average circularity of the silica which has yet to be subjected to the silicone oil treatment is not particularly limited, but is preferably 0.730 to 0.980, more preferably 0.750 to 0.950, and particularly preferably 0.800 to 0.945. Incidentally, a value to be measured by a method described in Examples is employed as the average circularity.

Known silicone oil can be used as the silicone oil used for a surface treatment of silica. As the silicone oil, dimethyl silicone oil, alkyl-modified silicone oil, amino-modified silicone oil, carboxyl-modified silicone oil, epoxy-modified silicone oil, fluorine-modified silicone oil, alcohol-modified silicone oil, polyether-modified silicone oil, methylphenyl silicone oil, methyl hydrogen silicone oil, mercapto-modified silicone oil, higher fatty acid-modified silicone oil, phenol-modified silicone oil, methacrylic-modified silicone oil, polyether-modified silicone oil, methylstyryl-modified silicone oil, and the like can be used.

Regarding the silicone oil used in the surface treatment within a range that does not impair the effect of the invention, one kind of silicone oil may be used or two or more kinds of silicone oil may be used in combination. Among these, dimethyl silicone oil is preferable as the silicone oil from the viewpoint of cost and ease of handleability. Further, the kinetic viscosity of dimethyl silicone oil at 25° C. is preferably 10 to 100 $mm^2/s$.

Incidentally, the silica particles may be subjected to a hydrophobizing treatment with an organic compound or a silane coupling agent before the silicone oil treatment.

Examples of the silicone oil treatment method include a dry method such as a spray dry method of spraying a treatment agent or a solution containing a treatment agent to particles floated in a gas phase, a wet method of immersing particles in a solution containing a treatment agent, followed by drying, and a mixing method of mixing a treatment agent and particles with a mixer.

The silica particles can be obtained by removing a solvent from the silica sol subjected to the silicone oil treatment, followed by drying. The silicone oil-treated silica particles thus obtained are subjected to a heat treatment at a temperature in a range of from 100° C. to several hundred degrees Celsius. As a result, the silicone oil can be bound to silica particles through a siloxane bond using hydroxyl groups on the surfaces of the silica particles, or the silicone oil itself can be further polymerized or cross-linked. The silicone oil may be acceleratedly reacted by adding a catalyst such as acid, alkali, a metal salt, zinc octylate, tin octylate, or dibutyltin dilaurate to the silicone oil in advance. Further, the silicone oil excessively treated may be removed by immersing the silica particles again in a solvent such as ethanol.

The number average primary particle size of the silicone oil-treated silica is preferably 5 to 300 nm, more preferably 20 to 200 nm, further preferably 30 to 200 nm, further more preferably 30 to 150 nm, and particularly preferably 30 to 90 nm. When the particle size of the silicone oil-treated silica is adjusted to 20 nm or more, silica is difficult to move on the toner base particles, the silicone oil-treated silica is easy to uniformly adhere onto the surfaces of the toner base particles, and concavity and convexity transferability is further improved. In addition, when the particle size of the silicone oil-treated silica is adjusted to 200 nm or less, the silicone oil-treated silica is easy to adhere onto the surfaces of the toner base particles so that cleaning property is further improved and charge stability is further improved. A value to be measured by the same method as a method of measuring the number average primary particle size of silica described in Examples is employed as the number average primary particle size of the silicone oil-treated silica.

Incidentally, the film thickness of the silicone oil-treated silica by the silicone oil treatment is extremely small with respect to the silica particle size, and thus the particle size of the silicone oil-treated silica can be controlled by changing the particle size of the silica particles.

The content of the silicone oil-treated silica in the toner is preferably 0.1 to 1.5 parts by mass with respect to 100 parts by mass of the toner base particles in consideration of the cleaning property and the effect as the external additive.

Hydrophobicity of the silicone oil-treated silica is preferably 40 to 100% and more preferably 60 to 100%. Incidentally, the hydrophobicity of the silicone oil-treated silica is represented by a measure of the wettability to methanol, and is defined by the following Equation (1).

[Math. 1]

$$\text{Hydrophobicity (\%)}=(a/(a+50))\times 100 \qquad \text{Equation (1)}$$

A method of measuring the hydrophobicity is as follows. The particles to be measured are weighed by 0.2 g and are added to 50 ml of distilled water which is placed in a beaker having an inner volume of 200 ml. The burette tip is immersed in the liquid, and methanol is slowly added dropwise from the burette until the whole of the particles is wet with slowly being stirred. When the amount of methanol necessary for completely wetting the particles is determined as a (ml), hydrophobicity is calculated by the above Equation (1).

<Titanium Oxide>

Examples of the titanium oxide include anatase type titanium oxide, rutile type titanium oxide, and metatitanic acid.

Net intensity of titanium (Ti) in the toner (hereinafter, also referred to as Net intensity of Ti) to be measured by X-ray fluorescence analysis is 0.5 to 5 kcps. The Net intensity of Ti indicates the amount of titanium oxide contained in the toner. When the Net intensity of Ti is smaller than 0.5 kcps, the concavity and convexity transferability is decreased (see Comparative Example 2 to be described later). The reason for this is considered that the content of titanium oxide in the toner is too small so that movement of the silicone oil-treated silica on the surface of the toner cannot be suppressed or the silicone oil-treated silica cannot be sufficiently cracked in the production process and silica is accordingly distributed unevenly on the surface of the toner. When the Net intensity of Ti is larger than 5 kcps, the cleaning property and the concavity and convexity transferability are decreased (see Comparative Example 3 to be described later). The reason for this is considered that the content of titanium oxide in the toner is too large so that collision frequency between titanium oxide and silica is increased or cracking force of silica due to titanium oxide is increased and the silicone oil treatment is accordingly peeled off to deteriorate lubricity, which leads to an increase in toner residue to a photoreceptor. In addition, the reason for this is considered that the content of titanium oxide in the toner is too large so that collision frequency between titanium oxide and silica is increased and the silicone oil treatment is accordingly peeled off to increase adhesion force with an intermediate transfer belt, which leads to a decrease in concavity and convexity transferability.

The Net intensity of Ti is preferably 0.9 to 4.8 kcps from the viewpoint of the concavity and convexity transferability, is more preferably 0.9 to 4.5 kcps, further preferably 0.9 to 3.5 kcps, and still further preferably 0.9 to 3.0 kcps from the viewpoint of the cleaning property, and is most preferably 1.5 to 3.0 kcps from the viewpoint of the balance between the concavity and convexity transferability and the cleaning property.

In the present specification, the Net intensity of Ti or the Net intensity of Si to be described below is measured as follows.

3 g of the toner sample pelletized by application of pressure is set to an X-ray fluorescence analyzer XRF-1700 (manufactured by SHIMADZU CORPORATION) and measurement is performed under the measuring conditions of a tube voltage of 40 kV, a tube current of 90 mA, a scan speed of 8 deg./min, and a step angle of 0.1 deg. For measurement, a Kα peak angle of a metal element to be desired to be measured is determined and used from the 20 table. The X-ray intensity obtained by subtracting background intensity from X-ray intensity in the peak angle representing that the metal element is present is obtained as the Net intensity of Ti or Si. Incidentally, a value determined to one decimal place by rounding off to two decimal places is employed as the Net intensity.

Incidentally, in a case where a sample is a developer, a carrier may be removed from the developer by a magnetic to separate a toner.

The average aspect ratio calculated from the ratio of the number average major axis diameter of titanium oxide to the number average minor axis diameter thereof (hereinafter, simply referred to as the average aspect ratio) is preferably 1 to 20 and more preferably 2 to 15. When the average aspect ratio is 2 or more, the contact area is large so that silica is less likely to move on the surface of the toner base particles. Thus, uneven distribution of silica subjected to the silicone oil treatment can be further suppressed and the concavity and convexity transferability is improved. When the average aspect ratio is 15 or less, adhesiveness of titanium oxide itself to the toner is relatively high so that movement of titanium oxide to the carrier can be suppressed and the charge stability can be maintained. From the viewpoint of the above-described effect, the average aspect ratio is further preferably 3 to 12. The average aspect ratio is obtained using the number average major axis diameter and the number average minor axis diameter as "the number average major axis diameter/the number average minor axis diameter". Regarding the number average major axis diameter and the number average minor axis diameter, for example, ten particles are selected in an electron microscopic photograph captured by a scanning electron microscope (SEM) "JEM-7401F" manufactured by JEOL Ltd.), the major axis diameters and the minor axis diameters of the respective particles are measured, and then average diameters thereof are obtained.

The number average major axis diameter of titanium oxide is preferably 20 to 200 nm and more preferably 20 to 120 nm in consideration of concavity and convexity transferability and charge stability.

The titanium oxide may be surfaced-treated, and examples of a surface treatment agent include a silane-based coupling agent, a titanium-based coupling agent, and silicone oil. In the surface-treated titanium oxide, the preferred average aspect ratio and number average major axis diameter are the same as described above.

A synthetic product or commercially available product may be used as titanium oxide. Examples of the method of synthesizing titanium oxide may include known methods such as a chlorine method (gas phase method), a sulfuric acid method (liquid phase method), and a sol-gel method. In addition, as the method for producing titanium oxide having the above-described aspect ratio, for example, the method disclosed in JP 2004-315356 A is exemplified. For example, in the method disclosed in JP 2004-315356 A, the aspect ratio can be controlled by reaction time of amorphous titanium oxide. According to this method, the aspect ratio may be controlled while the minor axis diameter of the amorphous titanium oxide is maintained.

A ratio of Net intensity of titanium (Ti) to Net intensity of silicon (Si) in the toner to be measured by X-ray fluorescence analysis (Net intensity of titanium (Ti)/Net intensity of silicon (Si), hereinafter, simply referred to as the Net intensity ratio) is preferably less than 0.13. When the Net intensity ratio is less than 0.13, the content of titanium oxide with respect to silica is sufficiently small and the effect of improving the cleaning property by addition of silica is less likely to be inhibited. In consideration of the effect of addition of titanium oxide (the improvement in concavity and convexity transferability), the Net intensity ratio is preferably 0.02 or more and more preferably 0.02 to 0.11, and in consideration of the cleaning property, is further preferably 0.02 to 0.09 and most preferably 0.03 to 0.09. The Net intensity ratio is calculated using a value of each Net intensity determined to two decimal places, and a value determined to two decimal places by rounding off to three decimal places is employed.

A lubricant can be also used as an external additive in order to improve cleaning property or transferability. Examples of the lubricant include higher fatty acid metal salts such as stearates of zinc, aluminum, copper, magnesium, calcium, and the like; oleates of zinc, manganese, iron, copper, magnesium, and the like; palmitates of zinc, copper, magnesium, calcium, and the like; linolates of zinc, calcium, and the like; and ricinolates of zinc, calcium, and the like.

The added amount of the external additive is preferably 0.1 to 10 parts by mass and more preferably 1 to 5 parts by mass with respect to 100 parts by mass of the toner base particles.

[Carrier]

<Core Material Particles>

The carrier contains core material particles and a resin coating layer that coats the core material particle. The core material particles are configured by, for example, various ferrites in addition to metal powder such as iron powder. Among these, ferrite is preferable.

As the ferrite, ferrites containing heavy metals such as copper, zinc, nickel, and manganese, and light metal ferrites containing alkali metals or alkaline earth metals.

The ferrite is a compound represented by a formula: $(MO)_x(Fe_2O_3)_y$ (the molar ratio of x and y, x+y=100 mole %), and the molar ratio of y of $Fe_2O_3$ constituting the ferrite is preferably 30 to 95 mole %. With the ferrite having the molar ratio y within such a range, since desired magnetization is easy to realize, it has an advantage of producing carrier particles which hardly cause adhesion between the carrier particles. M in the formula employs metal atoms of manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co), lithium (Li), and the like. These metal atoms can be used singly or in combination of two or more kinds thereof. Of them, from the viewpoint that residual magnetization is low and preferred magnetic characteristics are obtained, manganese, magnesium, strontium, lithium, copper, or zinc is preferable, and manganese, magnesium, or strontium is more preferable. M may be one kind or two or more kinds.

The core material particles may use a commercially available product or a synthetic product. In the case of synthesis, for example, the following method may be included.

First, an appropriate amount of a raw material is weighed and then pulverized and mixed preferably for 0.5 hours or more and more preferably for 1 to 20 hours in a wet-type media mill, a ball mill, a vibration mill, or the like. The pulverized product thus obtained is pelletized using a press forming machine or the like, and then the pellets are preferably subjected to temporary calcination at a temperature of 700 to 1200° C. for 0.5 to 5 hours.

It may be acceptable to pulverize the raw materials, subsequently add the pulverized product with water to form a slurry and granulate the slurry using a spray dryer without using the press forming machine. After the temporary calcination, the resulting product is pulverized with a ball mill, a vibration mill, or the like, and then water and, if necessary, a dispersant, a binder such as polyvinyl alcohol (PVA), and the like are added thereto. Thus, the viscosity is adjusted, the product is thus granulated, and main calcination is performed. A temperature of the main calcination is preferably 1000 to 1500° C., and a time for the main calcination is preferably 1 to 24 hours. The oxygen concentration at the time of the main calcination is preferably 0.5 to 5 volume %. When pulverization is carried out after the temporary calcination, water may be added and the pulverization may be carried out with a wet-type ball mill, a wet-type vibration mill, or the like.

There is no particular limitation on the pulverizer such as the ball mill or the vibration mill described above. However, in order to effectively and uniformly disperse the raw materials, it is preferable to use fine beads having a particle size of 1 cm or less as the medium to be used. Further, a degree of pulverization can be controlled by adjusting a diameter of the beads to be used, a composition, and a pulverization time.

The calcined product thus obtained is pulverized and classified. Regarding the classification method, a particle size is adjusted to a desired particle size using conventional methods such as air classification, mesh filtration, and sedimentation.

Thereafter, if necessary, the calcined product is subjected to an oxide film treatment by heating of the surface at a low temperature, whereby resistance thereof can be adjusted. For the oxide film treatment, a heat treatment can be carried out, for example, at 300 to 700° C. using a general rotary type electric furnace, a batch type electric furnace, or the like. If necessary, reduction may also be carried out before the oxide film treatment. In addition, after the classification, a low magnetic product may be separated by magnetic separation.

The average particle size of the core material particles is preferably 20 to 100 μm, more preferably 30 to 90 m, and further preferably 35 to 80 μm in terms of volume-based median diameter (D50). With such a range, a sufficient contact area with the toner can be ensured, and a high-quality toner image can be stably obtained. The median diameter (D50) can be measured by a laser diffraction-type particle size distribution measuring apparatus "HELOS & RODOS" (manufactured by Sympatec GmbH) equipped with a wet disperser.

<Resin Coating Layer>

The resin coating layer contains a coating resin, and the resin contains a constituent unit formed from an alicyclic (meth)acrylic acid ester monomer (also referred to as an alicyclic (meth)acrylic acid ester or an alicyclic (meth) acrylate monomer).

The alicyclic (meth)acrylic acid ester monomer is a monomer in which an alcohol-derived moiety of the (meth) acrylic acid ester monomer contains a cycloalkyl group.

As the alicyclic (meth)acrylic acid ester monomer, those having a cycloalkyl ring with 3 to 8 carbon atoms are preferable, and examples thereof include cyclopropyl methacrylate, cyclobutyl methacrylate, cyclopentyl methacrylate, cyclohexyl methacrylate, cycloheptyl methacrylate, cyclooctyl methacrylate, cyclopropyl acrylate, cyclobutyl acrylate, cyclopentyl acrylate, cyclohexyl acrylate, cycloheptyl acrylate, and cyclooctyl acrylate. Among them, from the viewpoint of mechanical strength and environmental stability of the charge amount, those having a cycloalkyl ring with 5 to 8 carbon atoms are more preferable, those containing cyclohexyl (meth)acrylate are further preferable, and those containing cyclohexyl methacrylate are particularly preferable. These may be used singly or in combination of two or more kinds thereof.

The content of the constituent unit derived from the alicyclic (meth)acrylic acid ester monomer in the resin constituting the resin coating layer is preferably 10 parts by mass or more (upper limit: 100 parts by mass) and more preferably 20 parts by mass or more (upper limit: 100 parts by mass) with respect to 100 parts by mass from the effect of the present invention. Incidentally, the content of the constituent unit is substantially the same as the content of the alicyclic (meth)acrylic acid ester monomer with respect to the total amount of the monomers when the resin is produced.

The coating resin constituting the resin coating layer may be obtained by copolymerization of the alicyclic (meth) acrylic acid ester monomer and another copolymerizable monomer.

Among them, as another monomer, a (meth)acrylic acid ester (a chain (meth)acrylic acid ester and/or a branched (meth)acrylic acid ester) other than the alicyclic (meth) acrylic acid ester is preferably contained, and from the viewpoint of the balance between abrasion resistance and low volume resistance, the coating resin more preferably contains a chain (meth)acrylic acid ester. That is, in a preferred embodiment, the coating resin constituting the resin coating layer further contains a constituent unit formed from a chain (meth)acrylic acid ester.

In a case where the coating resin contains a constituent unit formed from a chain (meth)acrylic acid ester, the content of the constituent unit is preferably 10 to 90 parts by mass with respect to 100 parts by mass of the resin, and is more preferably 20 to 80 parts by mass from the viewpoint of further improving the environmental stability of the charge amount and endurance. Incidentally, the content of the constituent unit is substantially the same as the content of the chain (meth)acrylic acid ester monomer with respect to the total amount of the monomers when the resin is produced.

The chain (meth)acrylic acid ester compound is a compound in which R in the (meth)acrylic acid ester compound ($CH_2$=CHCOOR or $CH_2$=C($CH_3$)COOR) is a chain alkyl group. Specific examples of the chain (meth)acrylic acid ester monomer include methyl (meth)acrylate, ethyl (meth) acrylate, propyl (meth)acrylate, n-butyl (meth)acrylate, hexyl (meth)acrylate, and octyl (meth)acrylate. Of them, from the viewpoint of further easily achieving the balance between abrasion resistance and low volume resistance, a (meth)acrylic acid ester in which the number of carbon atoms in the alkyl group is 1 to 4 is preferable, methyl (meth)acrylate is more preferable, and methyl methacrylate is particularly preferable.

The branched (meth)acrylic acid ester is a compound in which R in the (meth)acrylic acid ester compound ($CH_2$=CHCOOR or $CH_2$=C($CH_3$)COOR) is a branched alkyl group, and examples thereof include tert-butyl (meth) acrylate and 2-ethylhexyl (meth)acrylate.

In addition, the resin constituting the resin coating layer may contain a constituent unit derived from a monomer copolymerizable with the (meth)acrylic acid ester monomer. Examples of another monomer include (meth)acrylic monomers having a carboxyl group, an amino group, a hydroxyl group, an epoxy group, and the like and vinyl monomers such as styrene, vinyl acetate, and vinyl chloride.

There is no particular limitation on a method for producing the coating resin constituting the resin coating layer, and it is possible to appropriately use a conventionally known polymerization method such as a pulverization method, an emulsion dispersion method, a suspension polymerization method, a solution polymerization method, a dispersion polymerization method, an emulsion polymerization method, or an emulsion polymerization aggregation method. Particularly, from the viewpoint of particle size control, a coating resin is preferably produced by an emulsion polymerization method.

When the resin is produced by the emulsion polymerization method, there is no particular limitation on a polymerization initiator, a surfactant, and other optional additives (for example, a chain transfer agent and the like), and those conventionally known can be used. Moreover, polymerization conditions (temperature, time, atmosphere, and the like) are also not particularly limited and can be appropriately regulated.

The weight average molecular weight of the coating resin is preferably 300,000 to 1,000,000 and more preferably 350,000 to 500,000. With such a range, the strength of the coating resin becomes appropriate and the surfaces of the carrier particles are refreshed by depletion of the resin coating layer. Thus, the carrier can maintain a high charge amount even after being repeatedly used and endurance is accordingly improved.

The measurement of the weight average molecular weight of the coating resin is performed using gel permeation chromatography (GPC) under the following condition. That is, a measurement sample is dissolved in tetrahydrofuran so as to have a concentration of 1 mg/mL. As a dissolving condition, the sample is subjected to a treatment using an ultrasonic disperser for 5 minutes at room temperature. Subsequently, after processing with a membrane filter having a pore size of 0.2 m, a 10 μL sample solution is injected in GPC. In the molecular weight measurement of the sample, the molecular weight distribution of the sample is calculated using a calibration curve measured by using monodisperse polystyrene standard particles. Ten polystyrene samples are used for the calibration curve measurement.

<Measurement Conditions of GPC>

Apparatus: HLC-8220 (manufactured by Tosoh Corporation)

Column: TSK guard column+TSKgel Super HZM-M 3 series (manufactured by Tosoh Corporation)

Column temperature: 40° C.

Solvent: tetrahydrofuran

Flow rate: 0.2 mL/min

Detector: refractive index detector (RI detector)

The thickness of the resin coating layer is preferably 0.05 to 4 μm and more preferably 0.2 to 3 μm. When the thickness of the resin coating layer is in the above range, charging ability and endurance of the carrier particles can be improved.

Incidentally, the thickness of the resin coating layer can be obtained by the following method.

A measurement sample is prepared by cutting the carrier particles along a plane that passes through the center of the carrier particles with a focused ion beam apparatus "SMI2050" (manufactured by Hitachi High-Tech Science Corporation). A cross-section of the measurement sample is observed with a transmission electron microscope "JEM-2010F" (manufactured by JEOL Ltd.) in a field of view at a magnification of 5000 times, and an average value of an area with the largest thickness and an area with the smallest thickness in that field of view is determined as the thickness of the resin coating layer. Incidentally, the number of measurements is taken at 50 sites, and if the number of measurements is insufficient in a single field of view in a photograph, the number of fields of view is increased until the number of measurements of 50 is fulfilled.

The obtained resin may be used in production of a carrier after spray drying, freeze drying, or the like of the resin, or the resin in a dispersion liquid state may be used in production of a carrier. The use form of the resin can be appropriately selected depending on a method for producing a carrier.

The resin coating layer may contain, if necessary, charge controlling particles, electroconductive particles, and the like in addition to the resin described above.

Examples of the charge controlling particles include strontium titanate, calcium titanate, magnesium oxide, an azine compound, a quaternary ammonium salt, and triphenylmethane. The added amount of the charge controlling particles is preferably 2 to 40 parts by mass in the case of strontium titanate, calcium titanate, or magnesium oxide and preferably 0.3 to 10 parts by mass in the case of an azine compound, a quaternary ammonium salt, or triphenylmethane, with respect to 100 parts by mass of the coating resin.

Examples of the electroconductive particles (conductive agent) include carbon black, zinc oxide, and tin oxide. The added amount of the electroconductive particles is preferably 2 to 40 parts by mass in the case of carbon black, is preferably 2 to 150 parts by mass in the case of zinc oxide, and is preferably 2 to 200 parts by mass in the case of tin oxide with respect to 100 parts by mass of the resin.

<Method for Producing Carrier>

Examples of the method of coating the surfaces of the core material particles with the coating resin include a wet coating method and a dry coating method, and the resin coating layer can be provided by either method. Hereinafter, the respective methods will be described.

(Wet Coating Method)

Examples of the Wet Coating Method May Include:

(1) Fluidized Bed Type Spray Coating Method a method for producing carrier particles having the surfaces of the core material particles coated with a coating resin in which a coating liquid prepared by dissolving a coating resin in a solvent is spray-coated on the surfaces of core material particles using a fluidized spray coating device and then dried;

(2) Immersion Type Coating Method a method for producing carrier particles having the surfaces of the core material particles coated with a coating resin in which the core material particles are immersed in a coating liquid prepared by dissolving the coating resin in a solvent as the coating treatment and then dried; and (3) Polymerization Method a method for producing carrier particles having the surfaces of the core material particles coated with a coating resin in which the core material particles are immersed in a coating liquid prepared by dissolving a reactive compound for forming the coating resin (containing a polymerization initiator and the like in addition to the monomer for synthesizing the coating resin) in a solvent as the coating treatment and then subjected to the polymerization reaction by applying heat and the like to form a resin coating layer.

(Dry Coating Method)

The dry coating method is a method of coating the coating resin on the surfaces of the core material particles by applying a mechanical impact or heat (hereinafter, also referred to as the mechanochemical method) and is a method of forming a resin coating layer by the following Steps 1, 2, and 3.

Step 1: Materials prepared by blending the core material particle, the coating resin, and an additive to be added if necessary in appropriate amounts are mixed (mechanically stirred) at room temperature (20 to 30° C.) to attach the coating resin and the additive to be added if necessary on the surface of each of the core material particles as a uniform layer.

Step 2: Thereafter, the coating resin particles in the coating material attached to the surfaces of the core material particles are melted or softened by applying a mechanical impact or heat to fix, thereby forming a resin coating layer.

Step 3: Subsequently, the resultant is cooled to room temperature (20 to 30° C.).

In addition, it is also possible to form a resin coating layer having a desired thickness by repeating Step 1 to Step 3 several times if necessary.

In the case of producing the carrier by the dry coating method, the used amount of the resin is preferably 0.5 to 20 parts by mass, more preferably 1 to 10 parts by mass, and further preferably 2 to 5 parts by mass with respect to 100 parts by mass of the core material particles. With such a range, it is possible to obtain a carrier in which a balance between high endurance and low volume resistance is achieved.

It is preferable that Step 2 is a step in which the coating resin is spread, fixed, and coated on the surfaces of the core material particles by applying a mechanical impact force while heating the core material particles having the coating resin attached thereon at a temperature equal to or higher than the glass transition temperature of the coating resin, to form the resin coating layer.

Examples of the apparatus for applying a mechanical impact or heat in the above Step 2 may include a turbo mill, a pin mill, a grinding mill having a rotor and a liner, such as Kryptron, and a high-speed stirring mixer with a horizontal stirring blade. Among these, a high-speed stirring mixer with a horizontal stirring blade is preferable since a resin coating layer can be favorably formed.

In the case of heating the coating resin in Step 2, the heating temperature is preferably in a temperature range higher than the glass transition temperature of the coating resin by 5 to 20° C., and specifically, it is preferably in a range of 60 to 130° C. When the coating resin is heated at a temperature within such a range, the aggregation among the carrier particles does not occur, the coating resin is fixed on the surfaces of the core material particles, and thus a resin coating layer having a uniform layer can be formed. The heating time is appropriately set, but is, for example, 5 to 120 minutes.

In the above-described dry coating method, since an organic solvent or the like is also not used, a hole through which the solvent passes is not present in the resin coating layer, the resin coating layer is dense and strong, and the resin coating layer having favorable adhesiveness with the core material particles is formed so that carrier particles can be produced.

Regarding the method of forming carrier particles in which the surfaces of the core material particles are coated with the coating resin, from the viewpoint that a solvent is not used, the environmental load is small, and the coating resin can be uniformly coated on the surfaces of the core material particles, the formation of the carrier particles is particularly preferably performed by the above-described dry coating method.

[Toner Base Particles]

The "toner base particles" constitute the base of the toner particles. The toner base particles preferably contain a binder resin. In addition, the toner base particles may contain other constituent components such as a colorant, a releasing agent (wax), and a charge control agent, if necessary.

<Binder Resin>

As the binder resin constituting the toner base particles, those which are generally used as a binder resin constituting a toner can be used without particular limitation, and specific examples thereof include a styrene resin, an acrylic resin, a styrene-acrylic copolymer resin, a polyester resin, a silicone resin, an olefin-based resin, an amide resin, and an epoxy resin.

Among them, from the viewpoint of the low temperature fixability of the toner, the binder resin preferably contains a crystalline resin and more preferably contains a crystalline resin and an amorphous resin.

Herein, the crystalline resin indicates a resin that does not have a stepwise endothermic change but has a clear endothermic peak in the differential scanning calorimetry (DSC). The clear endothermic peak specifically means a peak in which the half width of the endothermic peak is within 15° C. when measured at a temperature raising rate of 10° C./min in the differential scanning calorimetry (DSC).

The crystalline resin is not particularly limited as long as it has the above-described characteristics, and crystalline resins conventionally known in the present technical field can be used. Specific examples thereof include a crystalline polyester resin, a crystalline polyurethane resin, a crystalline polyurea resin, a crystalline polyamide resin, and a crystalline polyether resin. The crystalline resin can be used singly or two or more kinds thereof can be used in combination.

Among them, the crystalline resin is preferably a crystalline polyester resin. Herein, the "crystalline polyester resin" is a resin satisfying the above-described endothermic properties among known polyester resins obtained by polycondensation reaction of bivalent or higher carboxylic acid (polyvalent carboxylic acid) and a derivative thereof with bivalent or higher alcohol (polyhydric alcohol) and a derivative thereof.

The melting point of the crystalline polyester resin is not particularly limited, but is preferably 55 to 90° C. When the melting point of the crystalline polyester resin is in the above range, sufficient low temperature fixability is obtainable. From such a viewpoint, the melting point of the crystalline polyester resin is more preferably 60 to 85° C. Incidentally, the melting point of the crystalline polyester resin can be controlled by the resin composition. Further, in the present specification, a value measured by a method described in Examples is employed as the melting point of the resin.

Each valence of the polyvalent carboxylic acid and the polyhydric alcohol that constitute the crystalline polyester resin is preferably 2 to 3 and particularly preferably 2. Thus, in the following description, a case where each valence is 2 (that is, a dicarboxylic component and a diol component) will be described in detail.

As the dicarboxylic component, aliphatic dicarboxylic acid is preferably used, and if necessary, aromatic dicarboxylic acid is concurrently used. As the aliphatic dicarboxylic acid, linear aliphatic dicarboxylic acid is preferably used. When the linear aliphatic dicarboxylic acid is used, there is an advantage that crystallinity is improved. The dicarboxylic component may be used singly or two or more kinds thereof may be used in combination.

Examples of the aliphatic dicarboxylic acid include oxalic acid, malonic acid, succinic acid, glutaric acid, adipic acid, pimellic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid.

As the dicarboxylic component, among the above-described aliphatic dicarboxylic acids, an aliphatic dicarboxylic acid having 6 to 14 carbon atoms is preferable and an aliphatic dicarboxylic acid having 8 to 14 carbon atoms is more preferable.

Examples of the aromatic dicarboxylic acid which can be used together with the aliphatic dicarboxylic acid include phthalic acid, terephthalic acid, isophthalic acid, orthophthalic acid, t-butylisophthalic acid, 2,6-naphthalenedicarboxylic acid, and 4,4'-biphenyldicarboxylic acid. Among these, from the viewpoint of availability and emulsification easiness, it is preferable to use terephthalic acid, isophthalic acid, and t-butylisophthalic acid.

In addition to the dicarboxylic acid, trivalent or higher polyvalent carboxylic acid such as trimellitic acid or pyromellitic acid, an anhydride of the carboxylic compound, an alkyl ester having 1 to 3 carbon atoms, and the like may be used.

As the dicarboxylic component for forming the crystalline polyester resin, the content of the aliphatic dicarboxylic acid is preferably set to 50 composition mole % or more, more preferably 70 composition mole % or more, further preferably 80 composition mole % or more, and particularly preferably 100 composition mole %. When the content of the aliphatic dicarboxylic acid in the dicarboxylic component is set to 50 composition mole % or more, the crystallinity of the crystalline polyester resin can be sufficiently ensured.

Further, as the diol component, an aliphatic diol is preferably used, and if necessary, a diol other than the aliphatic diol may be concurrently used. As the aliphatic diol, a linear aliphatic diol is preferably used. When the linear aliphatic diol is used, there is an advantage that crystallinity is improved. The diol component may be used singly or two or more kinds thereof may be used in combination.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and neopentyl glycol.

As the diol component, among the aliphatic diols, an aliphatic diol having 2 to 12 carbon atoms is preferable and an aliphatic diol having 3 to 10 carbon atoms is more preferable.

Examples of a diol which can be used together with the aliphatic diol include a diol having a double bond, and a diol having a sulfonic acid group, and specific examples of the diol having a double bond include 1,4-butenediol, 2-butene-1,4-diol, 3-butene-1,6-diol, and 4-butene-1,8-diol. Further, trihydric or higher alcohols such as glycerin, pentaerythritol, trimethylolpropane, and sorbitol may be used.

As the diol component for forming the crystalline polyester resin, the content of the aliphatic diol is preferably set to 50 composition mole % or more, more preferably 70 composition mole % or more, further preferably 80 composition mole % or more, and particularly preferably 100 composition mole %. When the content of the aliphatic diol in the diol component is set to 50 composition mole % or more, the crystallinity of the crystalline polyester resin can be ensured and a toner excellent in low temperature fixability is obtainable.

The weight average molecular weight (Mw) of the crystalline polyester resin is preferably 3,000 to 100,000, more preferably 4,000 to 50,000, and particularly preferably 5,000 to 20,000 from the viewpoint of reliably achieving the balance between sufficient low temperature fixability and excellent long-term heat-resistant storage stability. Incidentally, in the present specification, a value obtained by a method described in Examples is employed as the weight average molecular weight (Mw).

The ratio of the diol component and the dicarboxylic component to be used, which is a ratio of a hydroxyl group [OH] of the diol component to a carboxyl group [COOH] of the dicarboxylic component, [OH]/[COOH], is preferably 1.5/1 to 1/1.5 and more preferably 1.2/1 to 1/1.2.

A method for producing the crystalline polyester resin is not particularly limited, and the crystalline polyester resin can be produced using a known esterified catalyst by polycondensation (esterification) of the dicarboxylic acid and the diol. Examples of the catalyst which can be used at the time of producing the crystalline polyester resin include an alkali metal compound such as sodium or lithium; a compound containing a group 2 element such as magnesium or calcium; a compound of a metal such as aluminum, zinc, manganese, antimony, titanium, tin, zirconium, or germanium (for example, tetra-n-butyl titanate); a phosphite compound; a phosphate compound; and an amine compound. These may be used singly or in combination of two or more kinds thereof.

The polymerization temperature is not particularly limited, but is preferably 150 to 250° C. In addition, the polymerization time is not particularly limited, but is preferably 0.5 to 20 hours. During the polymerization, if necessary, the pressure inside the reaction system may be reduced.

In a case where the binder resin contains a crystalline resin (preferably a crystalline polyester resin), the content of the crystalline resin in the binder resin is not particularly limited, but is preferably less than 50 parts by mass, more preferably 30 parts by mass or less, and particularly preferably 10 parts by mass or less with respect to 100 parts by mass of the total amount of the binder resin. In the case of using a crystalline polyester resin as the crystalline resin, when the content is set to less than 50 parts by mass, environmental dependency on the charge amount caused by moisture absorbency of the crystalline polyester resin can be reduced. Meanwhile, the lower limit value of the content is not particularly limited, but in a case where the binder resin contains a crystalline resin (preferably a crystalline polyester resin), the lower limit value of the content is preferably 5 parts by mass or more. When the content of the crystalline resin is 5 parts by mass or more with respect to the total amount of the binder resin, a toner excellent in low temperature fixability is obtainable.

(Amorphous Resin)

The binder resin contained in the toner base particles preferably contains an amorphous resin together with the crystalline resin. The amorphous resin is a resin which does not have a melting point and has a relatively high glass transition temperature (Tg) when differential scanning calorimetry (DSC) is performed on the resin. The glass transition temperature (Tg) of the amorphous resin is not particularly limited, but from the viewpoint of reliably achieving fixability such as low temperature fixability and heat resistance such as heat-resistant storageability and blocking resistance, the glass transition temperature (Tg) thereof is preferably 25 to 60° C. Incidentally, in the present specification, a value measured by a method described in Examples is employed as the glass transition temperature (Tg) of the resin.

The amorphous resin is not particularly limited as long as it has the above-described characteristics, and amorphous resins conventionally known in the present technical field can be used. Specific examples thereof include a vinyl resin, a urethane resin, and a urea resin. Among them, from the reason that thermoplasticity is easily controlled, a vinyl resin is preferable.

The vinyl resin is not particularly limited as long as it is a resin obtained by polymerization of a vinyl compound, but examples thereof include a (meth)acrylic acid ester resin, a styrene-(meth)acrylic acid ester resin, and an ethylene-vinyl acetate resin. These may be used singly or in combination of two or more kinds thereof.

Among the vinyl resins, in consideration of plasticity at the time of heat fixing, a styrene-(meth)acrylic acid ester resin is preferable. Therefore, in the following description, the styrene-(meth)acrylic acid ester resin (hereinafter, also referred to as the "styrene-(meth)acrylic resin") as the amorphous resin will be described.

The styrene-(meth)acrylic resin is formed by addition polymerization of at least a styrene monomer and a (meth) acrylic acid ester monomer. The styrene monomer described herein includes, in addition to styrene represented by the structural formula: $CH_2{=}CH{-}C_6H_5$, styrene with a structure having a known side chain or functional group in the styrene structure. Further, the (meth)acrylic acid ester monomer described herein includes, in addition to an acrylic acid ester compound or methacrylic acid ester compound represented by $CH_2{=}CHCOOR$ (R is an alkyl group), an ester compound having a known side chain or functional group in the structure, such as an acrylic acid ester derivative or a methacrylic acid ester derivative. Incidentally, in the present specification, the "(meth)acrylic acid ester monomer" is a generic term for the "acrylic acid ester monomer" and the "methacrylic acid ester monomer".

An example of the styrene monomer and (meth)acrylic acid ester monomer that can form the styrene-(meth)acrylic resin will be described below.

Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers can be used singly or in combination of two or more kinds thereof.

Further, specific examples of the (meth)acrylic acid ester monomer include (meth)acrylic acid esters such as methyl (meth)acrylate, ethyl (meth)acrylate, propyl (meth)acrylate, n-butyl (meth)acrylate, t-butyl (meth)acrylate, isobutyl (meth)acrylate, n-octyl (meth)acrylate, 2-ethylhexyl (meth) acrylate, stearyl (meth)acrylate, lauryl (meth)acrylate, laurylphenyl, diethylaminoethyl methacrylate, and dimethylaminoethyl methacrylate. These (meth)acrylic acid ester monomers can be used singly or in combination of two or more kinds thereof.

The content of the constituent unit derived from the styrene monomer in the styrene-(meth)acrylic resin is preferably 40 to 90 parts by mass with respect to 100 parts by mass of the total amount of the resin. Further, the content of the constituent unit derived from the (meth)acrylic acid ester monomer in the resin is preferably 10 to 60 parts by mass with respect to the total amount of the resin.

Furthermore, the styrene-(meth)acrylic resin may contain, in addition to the styrene monomer and the (meth)acrylic acid ester monomer, the following monomer compounds.

Examples of such a monomer compound include a compound having a carboxyl group such as acrylic acid, methacrylic acid, maleic acid, itaconic acid, cinnamic acid, fumaric acid, maleic acid monoalkyl ester, or itaconic acid monoalkyl ester; and a compound having a hydroxyl group such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, or 4-hydroxybutyl (meth)acrylate. These monomer compounds can be used singly or in combination of two or more kinds thereof.

The content of the constituent unit derived from the monomer compound in the styrene-(meth)acrylic resin is preferably 0.5 to 20 parts by mass with respect to 100 parts by mass of the total amount of the resin.

The weight average molecular weight (Mw) of the styrene-(meth)acrylic resin is preferably 10,000 to 100,000. Incidentally, in the present specification, a value obtained by a method described in Examples is employed as the weight average molecular weight (Mw).

A method for producing the styrene-(meth)acrylic resin is not particularly limited, but examples thereof include methods of performing polymerization using an arbitrary polymerization initiator, which is generally used for polymerization of the monomer, such as a peroxide, a persulfide, a persulfate, or an azo compound, by a known polymerization technique such as bulk polymerization, solution polymerization, an emulsion polymerization method, a miniemulsion method, or a dispersion polymerization method. Further, a chain transfer agent to be generally used can be used for the purpose of adjusting the molecular weight. The chain transfer agent is not particularly limited, but examples thereof may include alkyl mercaptan such as n-octylmercaptan, and a mercapto fatty acid ester.

The content of the amorphous resin in the binder resin is not particularly limited, but is preferably more than 50 parts by mass, more preferably 70 parts by mass or more, and particularly preferably 90 parts by mass or more with respect to 100 parts by mass of the total amount of the binder resin. Meanwhile, the upper limit value of the content is not particularly limited, but is 100 parts by mass or less.

<Colorant>

As the colorant, carbon black, a magnetic material, a dye, a pigment, and the like can be arbitrarily used, and as the carbon black, channel black, furnace black, acetylene black, thermal black, lamp black, or the like is used. As the magnetic material, a ferromagnetic metal such as iron, nickel, or cobalt and alloys containing these metals, a ferromagnetic metal compound such as ferrite or magnetite, and the like can be used.

As the dye, C. I. Solvent Red 1, 49, 52, 58, 63, 111, and 122, C. I. Solvent Yellow 19, 44, 77, 79, 81, 82, 93, 98, 103, 104, 112, and 162, C. I. Solvent Blue 25, 36, 60, 70, 93, and 95, or the like can be used, and mixtures thereof can also be used. As the pigment, C. I. Pigment Red 5, 48:1, 48:3, 53:1, 57:1, 81:4, 122, 139, 144, 149, 166, 177, 178, and 222, C. I. Pigment Orange 31 and 43, C. I. Pigment Yellow 14, 17, 74, 93, 94, 138, 155, 180, and 185, C. I. Pigment Green 7, C. I. Pigment Blue 15:3, 15:4, and 60, or the like can be used, and mixtures thereof can also be used.

<Releasing Agent>

Examples of the releasing agent include hydrocarbon-based waxes such as low molecular weight polyethylene wax, low molecular weight polypropylene wax, Fischer Tropsch wax, microcrystalline wax, and paraffin wax, and ester waxes such as carnauba wax, pentaerythritol behenic acid ester, behenyl behenate, and behenyl citrate. These can be used singly or in combination of two or more kinds thereof.

Further, the melting point of the releasing agent is preferably 50 to 95° C. from the viewpoint of low temperature fixability and releasability of the toner in the electrophotography.

<Charge Control Agent>

As the charge control agent constituting the charge control agent particles, various known charge control agents that can be dispersed in an aqueous medium can be used. Specific examples thereof include nigrosine dyes, metal salts of naphthenic acid or higher fatty acid, alkoxylated amines, quaternary ammonium salt compounds, azo metal complexes, and salicylic acid metal salts or metal complexes thereof.

<Form of Toner Base Particles>

The form of the toner base particles is not particularly limited, but for example, may be a so-called single-layered structure (a homogeneous structure that is not a core-shell type), a core-shell structure, a multi-layered structure having three or more layers, or a domain-matrix structure. For the purpose of making the storage stability of the toner favorable, the toner base particles preferably have a core-shell structure having core particles and a shell layer coating the surfaces of the core particles.

<Core-Shell Structure>

Specifically, particles having a core-shell structure have a resin region (shell layer) having a relatively high glass transition temperature on the surface of a resin region (core particles) containing a colorant, a releasing agent, or the like that is, if necessary, added and having a relatively low glass transition temperature. The cross-sectional structure of such a core-shell structure can be confirmed, for example, by a known technique such as a transmission electron microscope (TEM) or a scanning probe microscope (SPM).

Incidentally, the core-shell structure is not limited to a structure in which the core particles are completely coated with the shell layer, and for example, includes a case where the core particles are not completely coated with the shell layer and the core particles are exposed in places.

Resin constituting the core particles and the shell layer are not particularly limited as long as they satisfy characteristics involved in the glass transition temperature.

There is no particular limitation on the binder resin constituting the core particles, but for example, the aforementioned amorphous resin and crystalline resin may be used. More preferably, as the binder resin constituting the core particles, a crystalline polyester resin, a styrene-(meth) acrylic resin, and the like may be used. As these resins, one or two or more kinds selected from the above-described examples are used.

At this time, the content ratio of the crystalline polyester resin is preferably 1 to 20 parts by mass and more preferably 3 to 10 parts by mass when the binder resin constituting the core particles is considered to 100 parts by mass.

There is no particular limitation on the binder resin constituting the shell layer, but for example, the aforementioned amorphous resin may be used. As the resin, one or two or more kinds selected from the above-described examples are used. Of them, the shell layer preferably contains the aforementioned styrene-(meth)acrylic resin.

In a case where the shell layer contains the styrene-(meth) acrylic resin, the content ratio of the resin is preferably 70 to 100 parts by mass and further preferably 90 to 100 parts by mass when the binder resin constituting the shell layer (the resin for shell) is considered to 100 parts by mass. When the content ratio of the styrene-(meth)acrylic resin in the resin for shell is within the above range, sufficient compatibility between the core particles and the shell layer is obtainable. As a result, a uniform thin shell layer can be formed so that heat-resistant storageability and fragmentation resistance become favorable and charging ability becomes favorable.

The content of the core particles is preferably 50 to 95 parts by mass and more preferably 60 to 90 parts by mass when the total amount of the resins of the core particles and the shell layer (the total amount of the binder resins) is considered to 100 parts by mass. In addition, the content of the shell layer is preferably 5 to 50 parts by mass and more preferably 10 to 40 parts by mass when the total amount of the resins of the core particles and the shell layer (the total amount of the binder resins) is considered to 100 parts by mass. When the content ratio of the resin for shell of the binder resin in the toner is within the above range, the balance between low temperature fixability and heat-resistant storageability can be achieved, which is preferable.

<Average Circularity>

From the viewpoint of improving charge environmental stability and low temperature fixability, the average circularity of the toner base particles is preferably 0.920 to 1.000 and more preferably 0.940 to 0.995. Herein, a value measured by a method described in Examples is employed as the average circularity.

<Particle Size>

Regarding the particle size of the toner base particles, the number-based median diameter is preferably 3 to 10 μm. By adjusting the number-based median diameter to the above range, reproducibility of thin lines or formation of high-quality photographic images can be achieved and the consumed amount of the toner can be reduced as compared to the case of using a toner having a large particle size. In addition, the flowability of the toner can also be ensured. Herein, a value measured by a method described in Examples is employed as the number-based median diameter of the toner base particles.

The number-based median diameter of the toner can be controlled by the concentration of an aggregating agent, the added amount of a solvent, or the fusing time in an aggregation and fusion step at the time of producing the toner to be describe later, and further by the composition of a resin component or the like.

[Method for Producing Toner Base Particles]

The toner base particles, that is, particles before addition of the external additive can be produced by a known production method. A method for producing the toner base particles is not particularly limited, and examples thereof may include a pulverization method, a suspension polymerization method, a miniemulsion polymerization aggregation method, an emulsion polymerization aggregation method, a dissolution suspension method, a polyester molecule elongation method, and other known methods. Of them, from the viewpoint of toner physical properties such as productivity and low temperature fixability, a pulverization method or an emulsion polymerization aggregation method is preferable. Of them, the emulsion polymerization aggregation method forms particles while the size or the form is controlled. Thus, this method may be considered as a method advantageous for production of a toner having a small particle size used for formation of high-quality images such as fine dot images and thin line images.

The emulsion polymerization aggregation method is a method for producing toner particles by mixing a dispersion liquid of binder resin fine particles obtained by emulsion polymerization with, if necessary, a dispersion liquid of colorant fine particles and another dispersion liquid of a toner particle constituents such as releasing agent fine particles, mildly aggregating the resultant mixture while a balance between repulsive force of the fine particle surface by pH adjustment and cohesive force by addition of an aggregating agent formed from an electrolyte, and controlling the shape by fusion between fine particles by heating and stirring at the same time of association while the average particle size and the particle size distribution are controlled. At this time, the binder resin fine particles may be formed to have a multi-layered structure such as a core-shell structure by multi-stage polymerization. The number of layers at this time is not particularly limited, but is preferably 2 to 3. As the preferred method for producing the toner according to the present invention, an example of a case where toner particles having a core-shell structure are obtained using an emulsification aggregation method will be described below.

(1) Step of preparing a resin particle dispersion liquid (dispersion liquid of resin particles for core/shell) in which binder resin particles containing, if necessary, an internal additive are dispersed in an aqueous medium (2) Step of arbitrarily preparing a colorant particle dispersion liquid in which colorant particles are dispersed in the aqueous medium (3) Step of mixing the colorant particle dispersion liquid and the dispersion liquid of resin particles for core to obtain a resin particle dispersion liquid for aggregation and aggregating and fusing the colorant particles and the binder resin particles in the presence of an aggregating agent to form aggregated particles as core particles (aggregation and fusion step)

(4) Step of adding a dispersion liquid of resin particles for shell containing binder resin particles for a shell layer into a dispersion liquid containing core particles and aggregating and fusing the particles for a shell layer to the surfaces of the core particles to form toner base particles having a core-shell structure (aggregation and fusion step)

(5) Step of filtering and separating the toner base particles from the dispersion liquid of toner base particles (toner base particle dispersion liquid) to remove a surfactant or the like (washing step)

(6) Step of drying the toner base particles (drying step)

(1) Step of Preparing a Resin Particle Dispersion Liquid (Dispersion Liquid of Resin Particles for Core/Shell) in which Binder Resin Particles Containing, if Necessary, an Internal Additive are Dispersed in an Aqueous Medium Toner particles having a core-shell structure can be obtained according to the following procedures: first, binder resin particles for core particles and colorant particles are aggregated and fused to produce core particles; then the binder resin particles for a shell layer are added into a dispersion liquid of core particles; and the binder resin particles for a shell layer are aggregated and fused to the surfaces of the core particles to form a shell layer coating the surfaces of the core particles. However, for example, in the above step (4), toner particles formed from single-layered particles can also be produced similarly without addition of the dispersion liquid of resin particles for shell.

In the emulsion polymerization aggregation method, first, resin particles for a binder resin having a particle size of around 100 nm are formed in advance by a polymerization method or a suspension polymerization method, and the resin particles are aggregated and fused to form toner particles. More specifically, monomers constituting a binder resin are input to an aqueous medium and dispersed, and these polymerizable monomers are polymerized by a polymerization initiator to produce particles of the binder resin (dispersion liquid).

Incidentally, in the present invention, the "aqueous medium" indicates a medium formed from 50 to 100 parts by mass of water and 0 to 50 parts by mass of a water-soluble organic solvent in 100 parts by mass of the aqueous medium. Examples of the water-soluble organic solvent may include methanol, ethanol, isopropanol, butanol, acetone, methyl ethyl ketone, and tetrahydrofuran. An alcohol-based organic solvent that does not dissolve a resin to be obtained is preferable. Further, into the aqueous medium, a dispersion stabilizer is typically added in order to prevent aggregation of the dispersed liquid droplets. As the dispersion stabilizer, known surfactants can be used, and a dispersion stabilizer selected from a cationic surfactant, an anionic surfactant, a non-ionic surfactant, and the like can be used. These surfactants may be used in combination of two or more kinds thereof. Incidentally, the dispersion stabilizer can also be used in a dispersion liquid of a colorant, an offset preventing agent, or the like. Specifically, surfactants described in paragraphs [0144] to [0146] of JP 2016-031460 A are exemplified.

(2) Step of Preparing a Colorant Particle Dispersion Liquid in which Colorant Particles are Dispersed in the Aqueous Medium In the case of containing a colorant, the colorant is separately dispersed in an aqueous medium to produce a colorant fine particle dispersion liquid. The volume-based median diameter (D50) of the colorant fine particles in the dispersion liquid is preferably 80 to 200 nm. The volume-based median diameter of the colorant fine particles in the dispersion liquid can be measured, for example, using Micro track particle size distribution measurement device UPA-150 manufactured by NIKKISO CO., LTD.

(3) Step of mixing the colorant particle dispersion liquid and the dispersion liquid of resin particles for core to obtain a resin particle dispersion liquid for aggregation and aggregating and fusing the colorant particles and the binder resin particles in the presence of an aggregating agent to form aggregated particles as core particles (aggregation and fusion step)

Then, the aforementioned resin particles and, if necessary, colorant fine particles are aggregated in the aqueous medium, and these particles are fused at the same time of aggregation to produce core particles. That is, a alkali metal salt or a salt of a group 2 element is added as an aggregating agent in the aqueous medium in which the resin particle dispersion liquid and the colorant particle dispersion liquid are mixed, the mixture is then heated at a temperature equal to or higher than the glass transition temperature of the resin particles to advance aggregation, and at the same time, the resin particles are fused. Then, when the size of the toner base particles becomes a target size, a salt is added to stop the aggregation. Thereafter, the reaction system is subjected to a heat treatment to age the shape of the toner base particles until a desired shape is obtained, and thus the toner base particles are completed.

At the time of performing aggregation, it is preferable that a leaving period of time at which the dispersion liquid is left after the aggregating agent is added (a period of time until heating is started) is shortened as much as possible, heating is started as fast as possible, and the temperature is adjusted to a temperature equal to or higher than the glass transition temperature of the binder resin. The leaving period of time is typically within 30 minutes and preferably within 10 minutes. The temperature at which the aggregating agent is added is not particularly limited, but is preferably a temperature equal to or lower than the glass transition temperature of the binder resin. Thereafter, it is preferable to rapidly elevate the temperature by heating, and the temperature raising rate is preferably set to 0.5° C./min or more. The upper limit of the temperature raising rate is not particularly limited, but from the viewpoint of suppressing occurrence of coarse particles caused by rapid advance of the fusion, the temperature raising rate is preferably set to 15° C./min or less. Further, after the temperature of the dispersion liquid for aggregation reaches a temperature equal to or higher than the glass transition temperature, the temperature of the dispersion liquid is held at a certain time so as to continue the fusion. According to this, growth (aggregation of the binder resin particles and the colorant particles) of the toner base particles and the fusion (loss of an interface between the particles) can be effectively advanced.

More specifically, in order to provide aggregability, it is preferable to adjust the pH to 9 to 12 by adding a base of an aqueous sodium hydroxide solution in advance to the dispersion liquids of colorant particles and binder resin particles. Then, it is preferable to add an aggregating agent such as an aqueous magnesium chloride solution in the dispersion liquid containing the binder resin particles and the colorant particles at 25 to 35° C. over 5 to 15 minutes under stirring. It is preferable that the appropriate amount of the aggregating agent used is 5 to 20 parts by mass with respect to 100 parts by mass of the total amount of solid contents of the binder resin particles and the colorant particles. Thereafter, it is preferable that the dispersion liquid is left for 1 to 6 minutes and the temperature thereof is elevated to 70 to 95° C. over 30 to 90 minutes. According to such a method, the aggregated resin particles and colorant particles can be fused.

The aggregating agent in the aggregation step is not particularly limited, but an aggregating agent selected from metal salts is suitably used. Examples thereof include salts of monovalent metals such as salts of alkali metals of sodium, potassium, lithium, and the like; salts of bivalent metals such as calcium, magnesium, manganese, and copper; and salts of trivalent metals such as iron and aluminum. Specific examples of the salts include sodium chloride, potassium chloride, lithium chloride, calcium chloride, magnesium chloride, zinc chloride, copper sulfate, magnesium sulfate, and manganese sulfate. Among these, salts of bivalent metals are particularly preferable. When a salt of a bivalent metal is used, aggregation can be performed with a smaller amount thereof. The aggregating agent may be used singly or two or more kinds thereof may be used in combination.

The dispersion liquid in the aggregation step may contain the releasing agent and the charge control agent that are described above, and further contain known additives such as a dispersion stabilizer and a surfactant. These additives may be added in the form of a dispersion liquid of the additive in the aggregation step or may be contained in the dispersion liquid of colorant fine particles or the dispersion liquid of the binder resin.

(4) Step of adding a dispersion liquid of resin particles for shell containing binder resin particles for a shell layer into a dispersion liquid containing core particles and aggregating and fusing the particles for a shell layer to the surfaces of the core particles to form toner base particles having a core-shell structure (aggregation and fusion step) In a case where a shell layer is formed uniformly on the surfaces of the core particles, it is preferable to employ an emulsification aggregation method. In the case of employing the emulsification aggregation method, an emulsified dispersion liquid of shell particles (dispersion liquid of resin particles for shell) is added into an aqueous dispersion liquid of core particles, and then the shell particles are aggregated/fused to the surfaces of the core particles so that a shell layer can be formed.

Specifically, the dispersion liquid of resin particles for shell is added to the core particle dispersion liquid in a state where the temperature in the aggregation and fusion step is maintained, and the resin particles for shell are slowly coated on the surfaces of the core particles while heating and stirring are continued.

Thereafter, at a stage in which the associated particles have a desired particle size, for example, a terminating agent such as sodium chloride is added to stop the particle growth, and the liquid containing the associated particles is continuously heated and stirred even after that. In this way, the shape of the associated particles is adjusted to have a desired circularity by the heating temperature, the stirring speed, and the heating time to obtain toner base particles. The condition of the heating and stirring operation is not particularly limited. Accordingly, toner base particles having a desired circularity and a uniform shape may be obtained.

Thereafter, preferably, an associated liquid containing the toner base particles is subjected to a cooling treatment to obtain a toner base particle dispersion liquid.

(5) Step of Filtering and Separating the Toner Base Particles from the Dispersion Liquid of Toner Base Particles (Toner Base Particle Dispersion Liquid) to Remove a Surfactant or the Like (Washing Step)

The dispersion liquid of toner base particles obtained by the aforementioned method is preferably filtered and dried. Examples of a filtration treatment method include a centrifugal separation method, a method of filtration under reduced pressure using a Nutsche funnel or the like, and a filtration method using a filter press or the like, and the filtration treatment method is not particularly limited. Then, the toner base particles which are filtered and separated (a cake-shaped aggregate) are washed with ion-exchanged water to remove adhering substances such as a surfactant and an aggregating agent. The washing treatment is preferably performed until the electrical conductivity of a filtrate becomes, for example, 3 to 10 S/cm.

(6) Step of Drying the Toner Base Particles (Drying Step)

There is no particular limitation on drying as long as the washed toner base particles can be dried, but examples of a dryer include known dryers such as a spray dryer, a vacuum freeze dryer, and a vacuum dryer. A standing tray dryer, a moving tray dryer, a fluidized bed dryer, a rotary dryer, an agitating dryer, an air flow dryer, or the like can be used. The moisture amount contained in the dried toner base particles is preferably 5 parts by mass or less and more preferably 2 parts by mass or less (lower limit: 0 parts by mass) with respect to 100 parts by mass of the toner base particles.

[Method for Producing Electrostatic Latent Image Developer]

Another embodiment of the present invention is a method for producing an electrostatic latent image developer, the method including: mixing toner base particles, silicone oil-treated silica, and titanium oxide and further mixing a carrier, in which an added amount of titanium oxide is 0.008 to 0.085 parts by mass with respect to 100 parts by mass of the toner base particles, the carrier has a resin coating layer coating core material particle, and the resin coating layer has a constituent unit formed from an alicyclic (meth)acrylate monomer.

When a specific amount of titanium oxide exists in this way at the time of cracking of the silicone oil-treated silica, the aggregation of the silicone oil-treated silica is suppressed and the silicone oil-treated silica may exist evenly in the toner base particles. The added amount of titanium oxide is preferably 0.015 to 0.08 parts by mass, more preferably 0.015 to 0.075 parts by mass, and further preferably 0.015 to 0.05 parts by mass with respect to 100 parts by mass of the toner base particles.

Further, from the viewpoint of further promoting the cracking of the silicone oil-treated silica and suppressing the aggregation of the silicone oil-treated silica, a mass ratio of the titanium oxide added with respect to the silicone oil-treated silica (the mass of the titanium oxide added/the mass of the silicone oil-treated silica added) is preferably 0.008 to 0.085, more preferably 0.015 to 0.075, and further preferably 0.015 to 0.05.

<Step of Mixing Toner Base Particles, Silicone Oil-Treated Silica, and Titanium Oxide (External Additive Treatment Step)>

A mechanical mixer can be used in a mixing treatment. As the mechanical mixer, a Henschel mixer, a Nauter mixer, a turbular mixer, or the like can be used. Among these, the mixing treatment may be performed using a mixer, which can apply shear force to particles to be treated, such as a Henschel mixer, by lengthening a mixing time or increasing a rotational peripheral speed of the stirring blade.

The mixing order in the step of mixing toner base particles, silicone oil-treated silica, and titanium oxide is not particularly limited, and the mixing order may be any mixing order of sequentially adding silicone oil-treated silica and titanium oxide to toner base particles; collectively adding silicone oil-treated silica and titanium oxide to toner base particles; and collectively adding toner base particles, silicone oil-treated silica, and titanium oxide. Further, the mixing condition is not particularly limited as long as it is a condition of uniformly mixing external additives, and for example, in the case of using a Henschel mixer, the peripheral speed of the edge of the stirring blade is preferably set to 30 to 80 m/s, and stirring and mixing are performed at 20 to 50° C. for about 10 to 30 minutes. By controlling the mixing strength, that is, the peripheral speed of the stirring blade, the mixing time, the mixing temperature, or the like using the mechanical mixer, it is possible to control the cracking degree of the external additive or adherence strength.

<Step of Mixing Carrier>

The carrier particles are mixed with the toner particles obtained above. Examples of the mixer may include a Henschel mixer, a Nauter mixer, and a V-type mixer. The mixing condition is not particularly limited as long as it is a condition that the carrier particles are mixed with the toner particles, and is typically about 20 to 40 minutes.

EXAMPLES

The effects of the present invention will be described by means of the following Examples and Comparative Examples. However, the technical scope of the present invention is not intended to be limited only to the following Examples. Incidentally, in the following Examples, unless otherwise noted, operations were performed at room temperature (20 to 25° C.). In addition, unless otherwise noted, "%" and "part(s)" mean "% by mass" and "part(s) by mass", respectively.

Example 1

<Production of Toner Base Particles>

[Preparation of Colorant Particle Dispersion Liquid]

In 1,600 parts by mass of ion-exchanged water, 90 parts by mass of sodium n-dodecyl sulfate was dissolved under stirring, 420 parts by mass of carbon black "MOGUL L" (manufactured by Cabot Corporation, pH 2) was slowly added thereto while the solution was stirred, and then the disperse treatment was carried out using a stirrer "CLEARMIX" (manufactured by M Technique Co., Ltd.) to prepare a colorant particle dispersion liquid in which carbon black particles [Bk] were dispersed. The particle size of the carbon black particles [Bk] in this dispersion liquid was measured using Micro track particle size distribution measurement device "UPA-150" (manufactured by NIKKISO CO., LTD.) and proved to be 85 nm in terms of volume-based median diameter.

[Production of Crystalline Polyester Resin]

A three-necked flask was loaded with 300 g of 1,9-nonanediol, 250 g of dodecanedioic acid, and a catalyst $Ti(OBu)_4$ (0.014 parts by mass with respect to 100 parts by mass of a carboxylic acid monomer) to prepare a liquid mixture, and then the pressure of the air inside the container was reduced by a pressure-reducing operation. Further, a nitrogen gas was introduced into the three-necked flask to allow the inside of the flask to have an inert atmosphere, and the liquid mixture was refluxed at 180° C. for 6 hours under mechanical stirring. Thereafter, an unreacted monomer component was removed by distillation under reduced pressure, and the temperature was gradually elevated to 220° C., followed by stirring for 12 hours. When the mixture became viscous, the mixture was cooled to obtain a crystalline polyester resin. The weight average molecular weight (Mw) of the obtained crystalline polyester resin (B1) was 19,500. Further, the melting point of the crystalline polyester resin was 75° C.

Mw of the crystalline polyester resin is determined according to the following procedures: tetrahydrofuran (THF) is flowed as a carrier solvent at a flow rate of 0.2 mL/min while maintaining a column temperature at 40° C. using an apparatus "HLC-8220" (manufactured by Tosoh Corporation) and a column "TSK guard column+TSKgel Super HZM-M 3 series" (manufactured by Tosoh Corporation); 10 μL of a sample solution is injected into the apparatus; a refractive index detector (RI detector) is used for detection; and a molecular weight distribution of the measurement sample is calculated using a calibration curve measured using monodisperse polystyrene standard particles.

The sample solution was prepared by dissolving the measurement sample in THF in a dissolving condition of performing a 5-minute treatment using an ultrasonic disperser at room temperature so as to have a concentration of 1 mg/mL, followed by filtration with a membrane filter having a pore size of 0.2 μm. Further, the calibration curve was prepared by measuring at least ten standard polystyrene samples. As the standard polystyrene sample, standard polystyrene samples (manufactured by Pressure Chemical Company) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ were used.

The melting point of the crystalline polyester resin is determined according to the following procedures: measurement is performed using a differential scanning calorimeter "Diamond DSC" (manufactured by PerkinElmer Co., Ltd.), and 3.0 mg of the sample is sealed in an aluminum-made pan and then placed in a holder, with an empty aluminum-made pan being set as a reference, according to measuring conditions (temperature elevating/cooling conditions) which undergoes, sequentially, a first heating process in which the temperature of the crystalline polyester resin is elevated from 0° C. to 200° C. at an elevating rate of 10° C./min, a cooling process in which the temperature of the crystalline polyester resin is cooled from 200° C. to 0° C. at a cooling rate of 10° C./min, and a second heating process in which the temperature of the crystalline polyester resin is elevated from 0° C. to 200° C. at an elevating rate of 10° C./min; and an endothermic peak top temperature derived from the crystalline polyester in the first heating process based on the DSC curve obtained by this measurement is determined as the melting point of the crystalline polyester resin.

[Preparation of Dispersion Liquid of Resin Particles (L) (First Step Polymerization)]

Into a 5 L reaction vessel equipped with a stirrer, a temperature sensor, a condenser, and a nitrogen inlet device, 4 g of polyoxyethylene (2) sodium dodecyl ether sulfate and 3,000 g of ion-exchanged water were charged, and the temperature of the obtained liquid mixture was elevated to 80° C. while stirring the liquid mixture at a stirring speed of 230 rpm under a nitrogen stream. After the temperature elevation, a solution in which 10 g of potassium persulfate was dissolved in 200 g of ion-exchanged water was added to the liquid mixture, and the liquid temperature of the liquid mixture was lowered to 75° C. A monomer liquid mixture having the following composition was added dropwise to the liquid mixture over 1 hour. Subsequently, the monomer was polymerized by heating the liquid mixture at 75° C. for 2 hours under stirring to prepare a dispersion liquid of resin particles (L1).

| | |
|---|---|
| Styrene | 568 g |
| n-Butyl acrylate | 164 g |
| Methacrylic acid | 68 g |

[Preparation of Dispersion Liquid of Resin Particles (L2) (Second Step Polymerization)]

Into a 5 L reaction vessel equipped with a stirrer, a temperature sensor, a condenser, and a nitrogen inlet device, a solution in which 2 g of polyoxyethylene (2) sodium dodecyl ether sulfate was dissolved in 3,000 g of ion-exchanged water was charged, and the obtained liquid mixture was heated to 80° C.

Meanwhile, a solution of a monomer having the following composition dissolved at 80° C. was prepared. Thereafter, the solution was added to the liquid mixture, and mixing and dispersion were performed for 1 hour using a mechanical disperser "CLEARMIX" (manufactured by M Technique Co., Ltd.) having a circulating path to prepare a dispersion liquid containing emulsified particles (oil droplets). Then, an initiator solution in which 5 g of potassium persulfate was dissolved in 100 g of ion-exchanged water was prepared, and added to the dispersion liquid. The obtained dispersion liquid was heated at 80° C. over 1 hour under stirring for polymerization of the monomer to prepare a dispersion liquid of resin particles (L2).

| | |
|---|---|
| Resin particles (L1) | 42 g (in terms of solid content) |
| Behenyl behenate | 70 g |
| Crystalline polyester resin | 70 g |
| Styrene | 195 g |
| n-Butyl acrylate | 91 g |
| Methacrylic acid | 20 g |
| n-Octylmercaptan | 3 g |

[Preparation of Dispersion Liquid of Resin Particles for Core (L3) (Third Step Polymerization)]

A solution in which 10 g of potassium persulfate was dissolved in 200 g of ion-exchanged water was further added to the dispersion liquid of resin particles (L2), and the obtained dispersion liquid was maintained at 80° C. A monomer liquid mixture having the following composition was added dropwise to the dispersion liquid over 1 hour. After completion of the dropwise addition, the obtained dispersion liquid was heated over 2 hours under stirring for polymerization of the monomer, and then the dispersion liquid was cooled to 28° C. to prepare a dispersion liquid of resin particles for core (L3).

| | |
|---|---|
| Styrene | 298 g |
| n-Butyl acrylate | 137 g |
| n-Stearyl acrylate | 50 g |
| Methacrylic acid | 64 g |
| n-Octylmercaptan | 6 g |

In the dispersion liquid of resin particles for core (L3), the glass transition temperature (Tg) of the resin particles was 48° C. and the weight average molecular weight (Mw) thereof was 48,000. Incidentally, the weight average molecular weight (Mw) of the resin particles for core was measured in the same manner as the measurement method of the weight average molecular weight of the crystalline polyester resin (B1). In addition, the glass transition temperature (Tg) was measured by the following method.

(Measurement of Glass Transition Temperature)

First, a DSC curve of the resin particles for core was obtained under the same condition as in the melting point measurement of the crystalline polyester resin. Based on the DSC curve, an intersection of an extended line of the base line before the rise of a first endothermic peak in the second heating process, and a tangent line representing the maximum gradient drawn between the rise portion of the first endothermic peak and the peak apex, is determined as the glass transition temperature (Tg).

[Preparation of Dispersion Liquid of Resin Particles for Shell (S1)]

A reaction vessel equipped with a stirrer, a temperature sensor, a condenser, and a nitrogen inlet device was charged with a surfactant solution in which 2.0 g of polyoxyethylene sodium dodecyl ether sulfate was dissolved in 3,000 g of ion-exchanged water, and the temperature of the solution was elevated to 80° C. under stirring at a stirring speed of 230 rpm under a nitrogen stream. To this solution was added an initiator solution in which 10 g of potassium persulfate was dissolved in 200 g of ion-exchanged water, and a monomer liquid mixture having the following composition was added dropwise to the solution over 3 hours. After the dropwise addition, the obtained liquid mixture was heated at 80° C. over 1 hour under stirring for polymerization of the monomer to prepare a dispersion liquid of resin particles for shell (S1).

| | |
|---|---|
| Styrene | 564 g |
| n-Butyl acrylate | 140 g |
| Methacrylic acid | 96 g |
| n-Octylmercaptan | 12 g |

In the dispersion liquid of resin particles for shell, the glass transition temperature (Tg) of the resin particles was 57° C. and the weight average molecular weight (Mw) thereof was 68,500. Incidentally, the weight average molecular weight (Mw) of the resin particles for shell was measured in the same manner as the measurement method of the weight average molecular weight of the crystalline polyester resin. In addition, the glass transition temperature (Tg) was measured in the same manner as the measurement method of the glass transition temperature of the resin particles for core.

[Production of Core Shell Particles (Aggregation and Fusing Step)]

A 5 L reaction vessel equipped with a stirrer, a temperature sensor, a condenser, and a nitrogen inlet device was charged with 360 g (in terms of solid content) of the dispersion liquid of resin particles for core (L3), 1,100 g of ion-exchanged water, and 40 g (in terms of solid content) of the dispersion liquid of colorant particles. The temperature of the obtained dispersion liquid was adjusted to 30° C., and subsequently a 5N aqueous sodium hydroxide solution was added to the dispersion liquid to adjust the pH of the dispersion liquid to 10. Next, an aqueous solution in which 60 g of magnesium chloride was dissolved in 60 g of ion-exchanged water was added to the dispersion liquid at 30° C. over 10 minutes under stirring. After the addition, the dispersion liquid was held at 30° C. for 3 minutes, and then the temperature was started to be elevated. The temperature of the dispersion liquid was elevated to 85° C. over 60 minutes, and the particle growth reaction was continued while holding the temperature of the dispersion liquid at 85° C. to prepare a dispersion liquid of precore particles (1). 80 g (in terms of solid content) of the dispersion liquid of resin particles for shell was added thereto, and the stirring was continued at 80° C. over 1 hour. The resin particles for shell were fused on the surfaces of the precore particles (1) for formation of a shell layer to obtain resin particles (1). Herein, an aqueous solution in which 150 g of sodium chloride was dissolved in 600 g of ion-exchanged water was added to the obtained dispersion liquid, and an aging treatment was performed at a liquid temperature of 80° C. At the time when the average circularity of the resin particles (1) was 0.960, the dispersion liquid was cooled to 30° C. The number-based median diameter of the cooled core shell particles (1) was 5.5 μm.

The number-based median diameter (Dnt) of the toner base particles was measured and calculated using an apparatus in which a data processing computer system is connected to "Multisizer 3 (manufactured by Beckman Coulter, Inc.)". In the measurement procedure, 0.02 g of toner particles were wetted with 20 ml of a surfactant solution (for the purpose of dispersing the toner particles, for example, a surfactant solution obtained by 10-fold dilution of a neutral detergent containing a surfactant component with pure water), followed by ultrasonic dispersion for 1 minute to produce a toner particle dispersion liquid. The toner base particle dispersion liquid was injected into a beaker containing ISOTON II (manufactured by Beckman Coulter, Inc.) in a sample stand, with a pipette, until the measurement concentration of the toner particles reached 5 to 10%, and measurement was made with the measuring device count set to 25,000. Incidentally, Multisizer 3 having an aperture diameter set to 100 μm is used. The measurement range ranging from 1 to 30 μm was divided into 256 segments and the frequency was calculated for each segment. The particle size at which the cumulative number percent from the larger particle-size side reaches 50% was determined as the number-based median diameter (Dnt).

The average circularity of the toner base particles was measured using a flow type particle image analyzer "FPIA-3000" (manufactured by Sysmex Corporation). Specifically, the toner base particles were wetted with an aqueous surfactant solution, and were dispersed via ultrasonic dispersion for 1 minute, followed by measuring with "FPIA-3000" in an HPF (high magnification imaging) mode at an appropriate concentration of the HPF detection number of 3,000 to 10,000 as a measuring condition. With this range, reproducible measurement values are obtainable. The circularity is calculated according to the following equation. Equation: Circularity=circumference length of a circle having an area equal to the projected area of an image of a particle)/(circumference length of the projection image of the particle). In addition, the average circularity is an arithmetic average value obtained by summing the circularities of the respective particles and dividing the sum by the total number of the measured particles.

[Production of Toner Base Particles (Washing and Drying Step)]

The dispersion liquid of core shell particles (1) generated in the aggregation and fusion step was subjected to solid-liquid separation using a centrifugal separator to form a wet cake of core shell particles. The wet cake was washed with ion-exchanged water at 35° C. until the electrical conductivity of the filtrate reached 5 μS/cm using the centrifugal separator, then moved to "Flash Jet Dryer" (manufactured by Seishin Enterprise Co., Ltd.) and dried until the moisture amount was 0.8 parts by mass with respect to 100 parts by mass of the toner base particles to produce toner base particles.

<Production of Silica Particles 1>

To an Erlenmeyer flask, 347.4 g of pure water was weighed, 110 g of tetramethoxysilane (TMOS) was added thereto under stirring, and then stirring was performed for 1 hour without any change to produce 457.4 g of a TMOS hydrolysis liquid.

Next, to a 3 L reaction vessel equipped with a stirrer, a dropping funnel, and a thermometer, 2,250 g of water and 112 g of ethylenediamine were input and mixed. The temperature of this solution was adjusted to 35° C., and the TMOS hydrolysis liquid was added at 2.5 mL/min under stirring.

After completion of addition of the TMOS hydrolysis liquid, the mixture was held for 30 minutes in this state, and then 4.5 g of 1 mmol/g ethylenediamine aqueous solution was added thereto to adjust the pH to 8 to 9.

Thereafter, while an alkali catalyst (1 mmol/g ethylenediamine aqueous solution) was appropriately added so as to maintain pH 8, the remaining TMOS hydrolysis liquid was added at 2.5 mL/min per 3 hours, and then this operation was continued. The total added amount was 457.4 g.

Also, after completion of dropwise addition of the TMOS hydrolysis liquid, stirring was further continued for 0.5 hour to perform hydrolysis and condensation to thereby obtain a mixed medium dispersion liquid of hydrophilic spherical silica particles. The particle size (number average primary particle size) of the obtained silica particles was 50 nm and the average circularity thereof was 0.930.

Incidentally, the number average primary particle sizes and the average circularities of the above-described silica particles and silicone oil-treated silica to be described below were measured by the following method.

(Measurement of Number Average Primary Particle Size)

A scanning electron microscopic image was captured and this photographic image was captured by a scanner. The photographic image was subjected to binarization processing in terms of the silica particles using an image processing analyzer LUZEX AP (manufactured by Nireco Corporation), Feret's diameters of 100 particles in the horizontal direction for one type of silica particles were calculated, and the average value thereof was determined as the number average primary particle size.

(Measurement of Average Circularity)

A scanning electron microscopic image was captured and 100 particles for one type of silica particles were subjected to image analysis. Respective circularities of the imaged silica particles were obtained by the following Equation (2), and a value obtained by averaging these circularities was determined as the average circularity.

[Math. 2]

$$\text{Circularity}=\text{circle equivalent circumference length}/\text{circumference length}=[2\times(A\pi)^{1/2}]/PM \quad \text{Equation (2)}$$

In Equation (2), PM represents a circumference length of a silica particle on an image, and A represents a projected area of the silica particle. The average circularity of the silica particles is obtained as a 50% circularity at a cumulative frequency of circularity of 100 silica particles obtained by the planar image analysis.

[Surface Treatment]

A solution in which 20 parts by mass of dimethyl silicone oil (KF-96-30cs manufactured by Shin-Etsu Chemical Co., Ltd.) was mixed with 50 parts by mass of ethanol was produced and sprayed to the above-obtained silica particles having a number average primary particle size of 50 nm by spray-drying to perform the hydrophobizing treatment of the silica particles. After the ethanol was removed by drying at 80° C., the silicone oil treatment was performed under stirring at 250° C. for 2 hours. The silica particles subjected the silicone oil treatment was added again to ethanol and then stirred, free oil was separated, and then drying was performed to obtain silica particles 1.

The particle size (number average primary particle size) of the obtained silica particles 1 was 50 nm and the average circularity thereof was 0.83.

<Production of Titanium Oxide Particles 1>

In this example, with reference to the method for producing needle-shaped titanium oxide fine particles described in JP 2004-315356 A, the production of titanium oxide particles was performed as follows.

To a 3 L reaction vessel equipped with a stirrer, a dropping funnel, and a thermometer, 450 parts by mass of titanium isopropoxide was added dropwise while 700 parts by mass of methanol was stirred, and then stirring was continued for 5 minutes. Thereafter, the generated titanium oxide particles were separated and recovered by a centrifugal separator, followed by drying under reduced pressure, to obtain amorphous titanium oxide.

The obtained amorphous titanium oxide was heated in the air at 800° C. for 5 hours by a high-temperature electric furnace to obtain rutile type titanium oxide particles.

To the aforementioned 3 L reaction vessel equipped with a stirrer, a dropping funnel, and a thermometer, 500 g of the obtained rutile type titanium oxide particles and 15 parts by mass of octyltrimethoxysilane were added and the mixture was stirred in 2 L of toluene for 10 hours for performing a hydrophobizing treatment. Thereafter, the reaction product was subjected to centrifugal separation to wash the reaction solvent, subjected to centrifugal separation again to be recovered, and then dried under reduced pressure to thereby obtain titanium oxide particles 1. The number average major axis diameter of the titanium oxide particles was 50 nm and the number average minor axis diameter thereof was 10 nm.

(External Additive Treatment Step)

To 100 parts by mass of the toner base particles produced in the above-described manner,

| | |
|---|---|
| Silica particles 1 | 1.0 part by mass |
| Titanium oxide particles 1 | 0.05 parts by mass |

were added, and the mixture was added to a Henschel mixer, model "FM20C/I" (manufactured by NIPPON COKE & ENGINEERING COMPANY, LIMITED), followed by stirring for 15 minutes at a blade edge peripheral speed of 40 m/s which had been set by adjusting the revolution speed of stirring blades, to produce a "toner 1" formed from the toner particles 1.

Further, the temperature of the product at the time of mixing the external additive was set to 40° C.±1° C., and the temperature inside the Henschel mixer was controlled by flowing cooled water at a flow rate of 5 L/min to the jacket of the Henschel mixer in a case where the temperature was 41° C., and by flowing cooled water so that the flow rate of the cooled water was 1 L/min in a case where the temperature was 39° C.

In this way, the toner 1 was obtained.

<Production of Carrier 1>

Production of Carrier (Production of Carrier Core Material Particles 1)

Raw materials were weighed so as to have MnO: 35 mole %, MgO: 14.5 mole %, $Fe_2O_3$: 50 mole %, and SrO: 0.5 mole %, and then mixed with water, and the mixture was pulverized for 5 hours with a wet media mill to obtain a slurry.

The obtained slurry was dried by a spray dryer to obtain spherical particles. After the particle size of the particles was adjusted, the particles were heated at 950° C. for 2 hours for performing temporary calcination. The particles were pulverized for 1 hour by a wet-type ball mill using stainless-steel beads having a diameter of 0.3 cm and then further pulverized for 4 hours using zirconia beads having a diameter of 0.5 cm. The main calcination was performed by adding, as a binder, 0.8 parts by mass of PVA with respect to 100 parts by mass of the solid content, and then granulating and drying the mixture by a spray dryer, followed by holding at a temperature of 1350° C. for 5 hours in an electric furnace.

Thereafter, crushing and classifying were performed to adjust the particle size, and then, a low-magnetic-force product was separated by magnetic separation to obtain carrier core material particles 1. The particle size (volume-based median diameter (D50)) of the carrier core material particles 1 was 75 μm.

(Production of Core Material Coating Resin 1)

To 0.3 parts by mass of an aqueous solution of sodium benzenesulfonate, cyclohexyl methacrylate and methyl methacrylate were added at "a mass ratio=50:50" (copolymerization ratio), followed by addition of potassium persulfate in an amount equivalent to 0.5 parts by mass of the total amount of monomers to perform emulsion polymerization, and drying was performed by spray-drying to produce a "core material coating resin 1". The weight average molecular weight of the obtained core material coating resin 1 was 500,000.

To a high-speed stirring mixer with horizontal stirring blades, 100 parts by mass of the "carrier core material particles 1" prepared above as the core material particles and 4.5 parts by mass of the "core material coating resin 1" were input, mixing and stirring was performed at 22° C. for 15 minutes under the condition of peripheral speed of the horizontal revolving blade of 8 m/sec, followed by mixing at 120° C. for 50 minutes, and then a coating material was coated on the surfaces of the core material particles by action of mechanical impact force (a mechanochemical method) to produce a "carrier 1".

(Production of Developer 1)

The toner 1 and the carrier 1 produced in the above-described manner were mixed to have a toner concentration of 5 parts by mass to produce a developer 1, and then the following evaluation was performed on the developer 1. The mixing was performed using a V-type mixer as a mixer for 30 minutes.

Example 2

A developer 2 was obtained in the same manner as in Example 1, except that the added amount of the titanium oxide particles 1 was changed from 0.05 parts by mass to 0.08 parts by mass.

Example 3

A developer 3 was obtained in the same manner as in Example 1, except that the added amount of the titanium oxide particles 1 was changed from 0.05 parts by mass to 0.015 parts by mass.

Example 4

(Production of Silica Particles 2)

Silica particles 2 were obtained in the same as in production of the silica particles 1, except that the addition speed of the TMOS hydrolysis liquid was changed from 2.5 mL/min to 1.0 mL/min in production of the silica particles 1 in Example 1. The particle size (number average primary particle size) of the obtained silica particles was 10 nm and the average circularity thereof was 0.940.

A developer 4 was obtained in the same manner as in Example 1, except that the silica particles 2 were used instead of the silica particles 1.

Example 5

(Production of Silica Particles 3)

Silica particles 3 were obtained in the same as in production of the silica particles 1, except that the addition speed of the TMOS hydrolysis liquid was changed from 2.5 mL/min to 1.5 mL/min in production of the silica particles 1 in Example 1. The particle size (number average primary particle size) of the obtained silica particles was 30 nm and the average circularity thereof was 0.935.

A developer 5 was obtained in the same manner as in Example 1, except that the silica particles 3 were used instead of the silica particles 1.

Example 6

(Production of Silica Particles 4)

Silica particles 4 were obtained in the same as in production of the silica particles 1, except that the addition speed of the TMOS hydrolysis liquid was changed from 2.5 mL/min to 4.2 mL/min in production of the silica particles 1 in Example 1. The particle size (number average primary particle size) of the obtained silica particles was 90 nm and the average circularity thereof was 0.921.

A developer 6 was obtained in the same manner as in Example 1, except that the silica particles 4 were used instead of the silica particles 1.

Example 7

(Production of Silica Particles 5)

Silica particles 5 were obtained in the same as in production of the silica particles 1, except that the addition speed of the TMOS hydrolysis liquid was changed from 2.5 mL/min to 10.1 mL/min in production of the silica particles 1 in Example 1. The particle size (number average primary particle size) of the obtained silica particles was 220 nm and the average circularity thereof was 0.91.

A developer 7 was obtained in the same manner as in Example 1, except that the silica particles 5 were used instead of the silica particles 1.

Examples 8 to 11

(Production of Titanium Oxide Particles 2)

Titanium oxide particles 2 were obtained in the same manner as in production of the titanium oxide particles 1, except that 450 parts by mass of titanium isopropoxide was added dropwise and then continuously stirred for 2 minutes in production of the titanium oxide particles 1.

(Production of Titanium Oxide Particles 3)

Titanium oxide particles 3 were obtained in the same manner as in production of the titanium oxide particles 1, except that 450 parts by mass of titanium isopropoxide was added dropwise and then continuously stirred for 3 minutes in production of the titanium oxide particles 1.

(Production of Titanium Oxide Particles 4)

Titanium oxide particles 4 were obtained in the same manner as in production of the titanium oxide particles 1, except that 450 parts by mass of titanium isopropoxide was added dropwise and then continuously stirred for 30 minutes in production of the titanium oxide particles 1.

(Production of Titanium Oxide Particles 5)

Titanium oxide particles 5 were obtained in the same manner as in production of the titanium oxide particles 1, except that 450 parts by mass of titanium isopropoxide was added dropwise and then continuously stirred for 90 minutes in production of the titanium oxide particles 1.

Developers 8 to 11 were obtained in the same manner as in Example 1, except that the titanium oxide particles 2 to 5 were used instead of the titanium oxide particles 1.

Comparative Example 1

A developer 12 was obtained in the same manner as in Example 1, except that the titanium oxide particles 1 were not used.

Comparative Example 2

A developer 13 was obtained in the same manner as in Example 1, except that the added amount of the titanium oxide particles 1 was changed from 0.05 parts by mass to 0.005 parts by mass.

Comparative Example 3

A developer 14 was obtained in the same manner as in Example 1, except that the added amount of the titanium oxide particles 1 was changed from 0.05 parts by mass to 0.2 parts by mass.

Comparative Example 4

A developer 15 was obtained in the same manner as in Example 1, except that hexamethyldisilazane (HMDS) was used instead of dimethyl silicone oil in production of the silica particles 1.

Comparative Example 5

(Production of Core Material Coating Resin 2) A coating material was produced only by methyl methacrylate instead of cyclohexyl methacrylate and methyl methacrylate to thereby obtain a core material coating resin 2. The weight average molecular weight of the obtained core material coating resin 2 was 450,000.

A developer 16 was obtained in the same manner as in Example 1, except that the core material coating resin 2 was used instead of the core material coating resin 1.

[Evaluation Method]

(Cleaning Property)

100,000 pieces of test images each having five vertical strip-shaped solid images having a width of 3 cm were continuously printed on A4 high-quality paper (65 g/m$^2$) (endurance printing), entire surface solid images after endurance were output, densities of five parts corresponding to strip parts and six parts corresponding to non-strip parts at the time of endurance were measured, and then evaluation of the maximum density difference was carried out. The results thereof are described in the following Table 1. Further, the results of the evaluation according to the following evaluation criteria are also described in Table 1.

○: The maximum density difference is 0.05 or less.

Δ: The maximum density difference is larger than 0.05 and 0.1 or less.

x: The maximum density difference is larger than 0.1.

(Concavity and Convexity Transferability)

A solid image was output on 203 g of LASERCK paper using an image forming apparatus "bizhub PRESS (registered trademark) C1100" (manufactured by Konica Minolta, Inc.), a toner amount Ti of the toner image on the intermediate transfer belt before the image was transferred to paper and a residual toner amount T2 on the intermediate transfer belt after the image was transferred to paper were measured, and then the transfer ratio was calculated using an equation: (T2/T1)×100(%). The results thereof are described in the following Table 1. Further, the results of the evaluation according to the following evaluation criteria are also described in Table 1.

○: The transfer ratio is 94% or more.

Δ: The transfer ratio is 90% or more and less than 94%.

x: The transfer ratio is less than 90%.

(Charge Stability)

The initial charge amount and the charge amount after endurance were measured. Specifically, the initial charge amount was measured by collecting the developer on the magnetic roll after ten pieces of images were printed and the charge amount after endurance was measured by collecting the developer on the magnetic roll after 100,000 pieces of images were printed. The charge amount difference (μC/g) between the initial charge amount and the charge amount after endurance was evaluated. The results thereof are described in the following Table 1. Further, the results of the evaluation according to the following evaluation criteria are also described in Table 1.

○: The charge amount difference is 7 μC/g or less.

Δ: The charge amount difference is more than 7 μC/g and 10 μC/g or less.

x: The charge amount difference is more than 10 μC/g.

TABLE 1

| | Developer | Silica particles | Particle size (nm) | Titanium oxide particles | Average aspect ratio | Added amount of titanium (parts by mass) | Ti Net intensity (kcps) | Net intensity of Ti/Net intensity of Si |
|---|---|---|---|---|---|---|---|---|
| Example 1 | 1 | Silica particles 1 | 50 | Titanium oxide particles 1 | 5 | 0.05 | 3.0 | 0.07 |
| Example 2 | 2 | Silica particles 1 | 50 | Titanium oxide particles 1 | 5 | 0.08 | 4.8 | 0.11 |
| Example 3 | 3 | Silica particles 1 | 50 | Titanium oxide particles 1 | 5 | 0.015 | 0.9 | 0.02 |
| Example 4 | 4 | Silica particles 2 | 10 | Titanium oxide particles 1 | 5 | 0.05 | 3.0 | 0.07 |
| Example 5 | 5 | Silica particles 3 | 30 | Titanium oxide particles 1 | 5 | 0.05 | 3.0 | 0.07 |
| Example 6 | 6 | Silica particles 4 | 90 | Titanium oxide particles 1 | 5 | 0.05 | 3.0 | 0.07 |
| Example 7 | 7 | Silica particles 5 | 220 | Titanium oxide particles 1 | 5 | 0.05 | 3.0 | 0.07 |
| Example 8 | 8 | Silica particles 1 | 50 | Titanium oxide particles 2 | 1 | 0.05 | 3.0 | 0.07 |
| Example 9 | 9 | Silica particles 1 | 50 | Titanium oxide particles 3 | 3 | 0.05 | 3.0 | 0.07 |
| Example 10 | 10 | Silica particles 1 | 50 | Titanium oxide particles 4 | 12 | 0.05 | 3.0 | 0.07 |
| Example 11 | 11 | Silica particles 1 | 50 | Titanium oxide particles 5 | 20 | 0.05 | 3.0 | 0.07 |

TABLE 1-continued

| | | | | | | | | |
|---|---|---|---|---|---|---|---|---|
| Comparative Example 1 | 12 | Silica particles 1 | 50 | — | — | 0 | — | — |
| Comparative Example 2 | 13 | Silica particles 1 | 50 | Titanium oxide particles 1 | 5 | 0.005 | 0.3 | 0.01 |
| Comparative Example 3 | 14 | Silica particles 1 | 50 | Titanium oxide particles 1 | 5 | 0.2 | 12.0 | 0.28 |
| Comparative Example 4 | 15 | Silica particles 6 | HMDS | Titanium oxide particles 1 | 5 | 0.05 | 3.0 | 0.07 |
| Comparative Example 5 | 16 | Silica particles 1 | 50 | Titanium oxide particles 1 | 5 | 0.05 | 3.0 | 0.07 |

| | Constituent unit of resin coating layer of carrier property | Cleaning property | | Concavity and convexity transfer-ability (%) | | Charge amount difference | |
|---|---|---|---|---|---|---|---|
| Example 1 | Cyclohexyl methacrylate + Methyl methacrylate | 0.02 | ○ | 97 | ○ | 4 | ○ |
| Example 2 | Cyclohexyl methacrylate + Methyl methacrylate | 0.05 | ○ | 94 | ○ | 4 | ○ |
| Example 3 | Cyclohexyl methacrylate + Methyl methacrylate | 0.02 | ○ | 94 | ○ | 4 | ○ |
| Example 4 | Cyclohexyl methacrylate + Methyl methacrylate | 0.02 | ○ | 91 | Δ | 4 | ○ |
| Example 5 | Cyclohexyl methacrylate + Methyl methacrylate | 0.02 | ○ | 94 | ○ | 4 | ○ |
| Example 6 | Cyclohexyl methacrylate + Methyl methacrylate | 0.02 | ○ | 97 | ○ | 7 | ○ |
| Example 7 | Cyclohexyl methacrylate + Methyl methacrylate | 0.08 | Δ | 97 | ○ | 9 | Δ |
| Example 8 | Cyclohexyl methacrylate + Methyl methacrylate | 0.02 | ○ | 92 | Δ | 4 | ○ |
| Example 9 | Cyclohexyl methacrylate + Methyl methacrylate | 0.02 | ○ | 94 | ○ | 4 | ○ |
| Example 10 | Cyclohexyl methacrylate + Methyl methacrylate | 0.02 | ○ | 97 | ○ | 7 | ○ |
| Example 11 | Cyclohexyl methacrylate + Methyl methacrylate | 0.02 | ○ | .97 | ○ | 9 | Δ |
| Comparative Example 1 | Cyclohexyl methacrylate + Methyl methacrylate | 0.02 | ○ | 86 | x | 4 | ○ |
| Comparative Example 2 | Cyclohexyl methacrylate + Methyl methacrylate | 0.02 | ○ | 88 | x | 4 | ○ |
| Comparative Example 3 | Cyclohexyl methacrylate + Methyl methacrylate | 0.15 | x | 87 | x | 4 | ○ |
| Comparative Example 4 | Cyclohexyl methacrylate + Methyl methacrylate | 0.2 | x | 89 | x | 4 | ○ |
| Comparative Example 5 | Methyl methacrylate | 0.1 | x | 89 | x | 13 | x |

From the above results, it is found that by using the developers of Examples 1 to 11, the concavity and convexity transferability is improved while the cleaning property is maintained. Moreover, the charge stability becomes also favorable. On the other hand, it is found that in the case of the developers of Comparative Examples 1 to 3 not containing titanium oxide particles, or containing titanium oxide particles in an amount out of the range, the concavity and convexity transferability is decreased or both the cleaning property and the concavity and convexity transferability are decreased. Further, it is found that in the case of Comparative Example 5 not having a constituent unit formed from an alicyclic (meth)acrylic acid ester as the resin of the coating resin layer of the carrier, the cleaning property is significantly decreased.

Furthermore, it is found from the comparison of Examples 1 and 8 to 11 that in the case of the developers of Examples 1, 9, and 10 in which the average aspect ratio calculated from the ratio of the number average major axis diameter to the number average minor axis diameter of the titanium oxide is 2 to 15, the concavity and convexity transferability and the charge stability are further excellent. Moreover, it is found from the comparison of Examples 1 and 4 to 7 that in the case of the developers of Examples 1, 5, and 6 in which the number average primary particle size of the silicone oil-treated silica is 30 to 200 nm, the concavity and convexity transferability and the charge stability are further excellent.

Although embodiments of the present invention have been described in detail, it is clearly understood that the same is by way of illustration and example only and not limitation, the scope of the present invention should be interpreted by terms of the appended claims.

What is claimed is:

1. An electrostatic latent image developer comprising:

a toner having toner base particles and an external additive; and a carrier, wherein the external additive contains silicone oil-treated silica and titanium oxide, and a number average primary particle size of the silicone oil-treated silica is 20 to 200 nm, Net intensity of titanium (Ti) in the toner to be measured by X-ray fluorescence analysis is 0.5 to 5 kcps, the carrier comprises a core material particle and a resin coating layer coating the core material particle, and the resin coating layer consists of a resin having a constituent unit formed from an alicyclic (meth)acrylic acid ester and optionally at least one of charge controlling particles or electroconductive particles.

2. The electrostatic latent image developer according to claim 1, wherein an average aspect ratio to be calculated from a ratio of a number average major axis diameter to a number average minor axis diameter of the titanium oxide is 2 to 15.

3. The electrostatic latent image developer according to claim 1, wherein a ratio of the Net intensity of titanium (Ti) to Net intensity of silicon (Si) in the toner to be measured by X-ray fluorescence analysis (Net intensity of titanium (Ti)/Net intensity of silicon (Si)) is less than 0.13.

4. The electrostatic latent image developer according to claim 1, wherein the toner base particles include a crystalline resin.

5. A method for producing an electrostatic latent image developer, comprising:

mixing toner base particles, silicone oil-treated silica, and titanium oxide; and further mixing a carrier, wherein a number average primary particle size of the silicone oil-treated silica is 20 to 200 nm, an added amount of the titanium oxide with respect to 100 parts by mass of the toner base particles is 0.008 to 0.085 parts by mass, and the carrier comprises a core material particle and a resin coating layer coating the core material particle, and the resin coating layer consists of a resin having a constituent unit formed from an alicyclic (meth)acrylic acid ester and optionally at least one of charge controlling particles or electroconductive particles.

6. The method for producing an electrostatic latent image developer according to claim 5, wherein an average aspect ratio to be calculated from a ratio of a number average major axis diameter to a number average minor axis diameter of the titanium oxide is 2 to 15.

7. The method for producing an electrostatic latent image developer according to claim 5, wherein a mass ratio of the titanium oxide added with respect to the silicone oil-treated silica is 0.008 to 0.085.

8. The method for producing an electrostatic latent image developer according to claim 5, wherein the toner base particles include a crystalline resin.

9. An electrostatic latent image developer comprising:

a toner having toner base particles and an external additive; and a carrier, wherein the external additive contains silicone oil-treated silica and titanium oxide, and an average aspect ratio to be calculated from a ratio of a number average major axis diameter to a number average minor axis diameter of the titanium oxide is 2 to 15, Net intensity of titanium (Ti) in the toner to be measured by X-ray fluorescence analysis is 0.5 to 5 kcps, the carrier comprises a core material particle and a resin coating layer coating the core material particle, and the resin coating layer consists of a resin having a constituent unit formed from an alicyclic (meth)acrylic acid ester and optionally at least one of charge controlling particles or electroconductive particles.

* * * * *